US007427974B2

(12) United States Patent
Asao et al.

(10) Patent No.: US 7,427,974 B2
(45) Date of Patent: Sep. 23, 2008

(54) DISPLAY APPARATUS, LIQUID CRYSTAL DISPLAY APPARATUS AND DRIVING METHOD FOR DISPLAY APPARATUS

(75) Inventors: Yasufumi Asao, Kanagawa-ken (JP); Masahiro Terada, Kanagawa-ken (JP); Takeshi Togano, Kanagawa-ken (JP); Shosei Mori, Kanagawa-ken (JP); Takashi Moriyama, Kanagawa-ken (JP); Ryuichiro Isobe, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 425 days.

(21) Appl. No.: 10/885,614

(22) Filed: Jul. 8, 2004

(65) Prior Publication Data

US 2004/0239612 A1 Dec. 2, 2004

Related U.S. Application Data

(62) Division of application No. 09/338,426, filed on Jun. 23, 1999, now Pat. No. 6,809,717.

(30) Foreign Application Priority Data

Jun. 24, 1998 (JP) ..... 10-177145
Mar. 24, 1999 (JP) ..... 11-080490

(51) Int. Cl.
*G09G 3/36* (2006.01)

(52) U.S. Cl. ..... 345/89; 345/96; 345/690; 345/209

(58) Field of Classification Search ..... 345/57–102, 345/690, 211, 609
See application file for complete search history.

(56) References Cited

U.S. PATENT DOCUMENTS 4,367,924 A 1/1983 Clark et al. ..... 350/334
5,122,791 A * 6/1992 Gibbons et al. ..... 345/102
5,465,168 A 11/1995 Koden et al. ..... 359/56
5,555,110 A 9/1996 Konuma et al. ..... 345/97

(Continued)

FOREIGN PATENT DOCUMENTS

JP 56-107216 8/1981

(Continued)

OTHER PUBLICATIONS

T. Uchida et al., "Director orientation of a ferroelectric liquid crystal on substrates with rubbing treatment: the effect of surface anchoring strength," Liquid Crystals, 1989, vol. 5, No. 4, 1127-1137.

(Continued)

*Primary Examiner*—Duc Q Dinh
(74) *Attorney, Agent, or Firm*—Fitzpatrick, Cella, Harper & Scinto

(57) ABSTRACT

A display apparatus is constituted by a display device including a plurality of pixels and control means for effecting a plurality of displaying operations at each pixel. Each of the displaying operation includes at least a first operation for displaying a first image at a first luminance and a second operation for displaying a second image substantially identical to the first image at a second luminance, said first and second luminances being non-zero and different from each other. One of the first and second luminances may preferably be smaller than ⅕ of the other luminance.

6 Claims, 18 Drawing Sheets

U.S. PATENT DOCUMENTS

| | | | | | |
|---|---|---|---|---|---|
| 5,691,783 | A | | 11/1997 | Numao et al. | 349/48 |
| 5,856,814 | A | * | 1/1999 | Yagyu | 345/89 |
| 5,900,852 | A | * | 5/1999 | Tanaka et al. | 345/87 |
| 5,963,187 | A | | 10/1999 | Tanaka et al. | 345/97 |
| 5,990,991 | A | | 11/1999 | Tillin et al. | 349/136 |
| 6,016,133 | A | | 1/2000 | Nito et al. | 345/89 |
| 6,052,103 | A | | 4/2000 | Fujiwara et al. | 345/89 |
| 6,133,894 | A | | 10/2000 | Yagyu | 345/87 |

FOREIGN PATENT DOCUMENTS

| | | |
|---|---|---|
| JP | 3-243915 | 10/1991 |
| JP | 6-33059 | 2/1994 |
| JP | 7-140933 | 6/1995 |
| JP | 7-318939 | 12/1995 |
| JP | HEI 9-325715 | 12/1997 |
| JP | 10-177145 | 6/1998 |

OTHER PUBLICATIONS

M. Schadt et al., "Voltage-Dependent Optical Activity of a Twisted Nematic Liquid Crystal," Appl. Phys. Letters, vol. 18, No. 4, Feb. 15, 1971, 127-128.

Oct. 21, 2003 Japanese Official Action in Japanese Patent Appln. No. 1999-166104 (excerpt translation).

* cited by examiner

C1 ALIGNMENT

C2 ALIGNMENT

C1 ALIGNMENT

C2 ALIGNMENT

C1 ALIGNMENT

C2 ALIGNMENT

DISPLAY APPARATUS, LIQUID CRYSTAL DISPLAY APPARATUS AND DRIVING METHOD FOR DISPLAY APPARATUS

This is a divisional application of application Ser. No. 09/338,426, filed Jun. 23, 1999.

FIELD OF THE INVENTION AND RELATED ART

The present invention relates to a display apparatus, particularly by a liquid crystal display apparatus including a liquid crystal device for use in light-valves for flat-panel displays, projection displays, printers, etc., and a driving method for the (liquid crystal) display apparatus.

As a type of a nematic liquid crystal display device used heretofore, there has been known an active matrix-type liquid crystal device wherein each pixel is provided with an active element (e.g., a thin film transistor (TFT)).

As a nematic liquid crystal material used for such an active matrix-type liquid crystal device using a TFT, there has been presently widely used a twisted nematic (TN) liquid crystal as disclosed by M. Schadt and W. Helfrich, "Applied Physics Letters", Vol. 18, No. 4 (Feb. 17, 1971), pp. 127-128.

In recent years, there has been proposed a liquid crystal device of In-Plain Switching mode utilizing an electric field applied in a longitudinal direction of the device, thus improving a viewing angle characteristic being problematic in TN-mode liquid crystal displays. Further, a liquid crystal device of a super twisted nematic (STN) mode without using the active element (TFT etc.) has also be known as a representative example of the nematic liquid crystal display device.

Accordingly, the nematic liquid crystal display device includes various display or drive modes. In any mode however, the resultant nematic liquid crystal display device has encountered a problem of a slow response speed of several ten milliseconds or above.

In order to solve the above-mentioned difficulties of the conventional types of nematic liquid crystal devices, a liquid crystal device using a liquid crystal exhibiting bistability ("SSFLC", Surface Stabilized FLC), has been proposed by Clark and Lagerwall (Japanese Laid-Open Patent Application (JP-A) 56-107216, U.S. Pat. No. 4,367,924). As the liquid crystal exhibiting bistability, a chiral smectic liquid crystal or a ferroelectric liquid crystal (FLC) having chiral smectic C phase (SmC*) is generally used. Such a chiral smectic (ferroelectric) liquid crystal has a very quick response speed because it causes inversion switching of liquid crystal molecules by the action of an applied electric field on spontaneous polarizations of their liquid crystal molecules. In addition, the chiral smectic liquid crystal develops bistable states showing a memory characteristic and further has an excellent viewing angle characteristic. Accordingly, the chiral smectic liquid crystal is considered to be suitable for constituting a display device or a light valve of a high speed, a high resolution and a large area.

In recent years, as another liquid crystal material, an antiferroelectric liquid crystal showing tristability (tristable states) has caught attention. Similarly as in the ferroelectric liquid crystal, the antiferroelectric liquid crystal causes molecular inversion switching due to the action of an applied electric field on its spontaneous polarization, thus providing a very high-speed responsiveness. This type of the liquid crystal material has a molecular alignment (orientation) structure wherein liquid crystal molecules cancel or counterbalance their spontaneous polarizations each other under no electric field application, thus having no spontaneous polarization in the absence of the electric field.

The above-mentioned ferroelectric and antiferroelectric liquid crystal causing inversion switching based on spontaneous polarization are liquid crystal materials assuming smectic phase (chiral smectic liquid crystals). Accordingly, by using these liquid crystal materials capable of solving the problem of the conventional nematic liquid crystal materials in terms of response speed, it has been expected to realize a smectic liquid crystal display device.

As described above, the (anti-)ferroelectric (or chiral smectic) liquid crystal having a spontaneous polarization has been expected to be suitable for use in displays exhibiting a high-speed response performance in the near future.

In the case of the above-mentioned device (cell) using the (anti-)ferroelectric liquid crystal exhibiting bistability or tristability, however, it has been difficult to effect a gradation display in each pixel based on its display principle.

In recent years, in order to allow a mode of controlling various gradation levels, there have been proposed liquid crystal devices using a specific chiral smectic liquid crystal, such as a ferroelectric liquid crystal of a short pitch-type, a polymer-stabilized ferroelectric liquid crystal or an anti-ferroelectric liquid crystal showing no threshold (voltage) value. However, these devices have not been put into practical use sufficiently.

On the other hand, with respect to a liquid crystal display apparatus, it has been clarified by recent studies that it is difficult to attain a sufficient human-sensible high-speed motion picture response characteristic only by simply increasing a response speed of a liquid crystal portion of a conventional liquid crystal device (using a nematic TN or STN) mode)(as described in, e.g., "Shingaku Giho" (Technical Report of IEICD), EID 96-4 (1996-06, p. 19).

According to results of these studies, it has been concluded that a scheme wherein a time aperture (opening) rate is decreased to at most 50% by using a shutter or a double-rate display scheme is effective in improving motion picture qualities as a scheme by which a human-sensible high-speed motion picture responsiveness is provided.

However, in the conventional nematic (display) mode, the response speed of a liquid crystal is insufficient, thus failing to be applied to the above motion picture display schemes. Further, in order to realize the high-speed motion picture display as described above by using the conventionally proposed high-speed responsive chiral smectic liquid crystal devices including those using a ferroelectric liquid crystal of a short pitch-type or a polymer-stabilized type and a threshold-less antiferroelectric liquid crystal, any (chiral) smectic mode is accompanied with difficulties, such as complicated driving method and peripheral circuits, thus leading to an increase in production cost. Even when a time aperture rate is completely set to 50% or below, the entire display device (apparatus) is also correspondingly decreased in brightness of 50% or below. As a result, it is clear that the resultant display device causes a lowering in (display) luminance.

In recent years, it has been desired to effect full-color display using a liquid crystal device. As one of methods for effecting full-color display, there has been known a method wherein a liquid crystal device is irradiated with respective color lights (e.g., red light, green light and blue light) in succession to effect switching of liquid crystal molecules under the respective color light irradiations. Even in such a liquid crystal device, however, if the time aperture rate is decreased to at most 50% as described above, the resultant liquid crystal device is similarly accompanied with a (display) luminance lowering problem.

More specifically, FIG. 19 is a block diagram of a conventional liquid crystal apparatus.

Referring to FIG. 19, the liquid crystal apparatus includes a liquid crystal device (panel) 80, a color light source 101 capable of emitting respective color lights (of red (R), green (G) and blue (B)) and a color light source driving unit 102 for driving the color light source 101 based on synchronizing signals.

The liquid crystal device 80 shown in FIG. 19 includes 480 scanning lines supplied with scanning (data) signals X001 to X480, respectively, through a Y-driver 92. These X— and Y-drivers 91 and 92 are driven by applying a drive voltage carrying drive signals. The synchronizing signals supplied to the color light source driving unit are separated from the drive signals.

FIG. 20 is a time chart for illustrating a driving method of the conventional liquid crystal apparatus shown in FIG. 19.

Referring to FIG. 20, when the liquid crystal apparatus is driven, one frame period F0 is divided into three field periods F1, F2 and F3. In this instance, when a frame frequency is set to 60 Hz, one frame period F0 is ca. 16.7 msec. and each of the field period F1, F2 and F2 is ca. 5.5 msec. The liquid crystal device 80 is irradiated successively with the respective color lights (R, G, B) from the color light source 101 in the field periods F1, F2 and F3, respectively (FIGS. 20(*a*), (*b*) and (*c*)). In each of the field periods F1, F2 and F3, with respect to each of scanning lines (S001 to S048), a black and white (monochromatic) image (for R in F1, for G in F2 or for B in F3) is successively displayed in a prescribed display period (RD, GD or BD) as shown in FIG. 20(*d*). As a result, these resultant (color) images are visually color-mixed to be recognized as a desired full-color image.

According to such a liquid crystal apparatus, it is not necessary to provide the liquid crystal device 80 with a color filter, thus obviating problems due to the formation of the color filter, such as a lowering in production yield, an attenuation (lowering in luminance) of illumination light at the color filter and an increase in quantity of light of a backlight (light source) for preventing the lowering in luminance. On the other hand, however, the image display period (Rd, GD or BD) is half of the corresponding field period (F1, F2 or F3), thus resulting in an about half utilization of the color light source 101. Accordingly, the resultant luminance is lowered in spite of no attenuation of the illumination light by the use of the color filter, so that the color light source 101 is required to provide a higher luminance in order to prevent the lowering in luminance of the liquid crystal device 80.

In the case where such a liquid crystal device 80 uses a ferroelectric liquid crystal (e.g., a liquid crystal assuming chiral smectic C phase), it is necessary to apply a reset pulse (voltage) in combination with a writing pulse. Even when the reset pulse is set to have a negative polarity and the writing pulse is set to have a positive polarity, the resultant writing pulse becomes smaller depending on displaying gradation levels in some cases, thus resulting in DC voltage component applied to the liquid crystal to cause an occurrence of so-called burning or sticking.

SUMMARY OF THE INVENTION

In view of the above-mentioned problems, an object of the present invention is to provide a display apparatus, particularly a liquid crystal display apparatus, capable of effecting gradation control with high-speed responsiveness while ensuring a practical brightness to improve motion picture image qualities without using a complicated circuit.

Another object of the present invention is to provide a driving method for the (liquid crystal) display apparatus.

According to the present invention, there is provided a display apparatus, comprising:

a display device including a plurality of pixels, and control means for effecting a plurality of displaying operations at each pixel, each displaying operation including at least a first operation for displaying a first image at a first luminance and a second operation for displaying a second image substantially identical to the first image at a second luminance, said first and second luminances being non-zero and different from each other.

According to the present invention, there is also provided a liquid crystal display apparatus, comprising:

a liquid crystal device including a layer of liquid crystal, a pair of substrates disposed to sandwich the liquid crystal, and a polarizer disposed on at least one of the substrates, at least one of the substrates being provided with an alignment film for aligning the liquid crystal in contact therewith, the pair of substrates respectively having thereon mutually intersecting electrodes for applying a voltage to the liquid crystal thereby forming a matrix of pixels each at an intersection of the electrodes on the pair of substrate, and control means for effecting a plurality of displaying operations at each pixel, each displaying operation including at least a first operation for displaying a first image at a first luminance and a second operation for displaying a second image substantially identical to the first image at a second luminance, said first and second luminances being non-zero and different from each other.

According to the present invention, there is further provided a liquid crystal apparatus, comprising:

a liquid crystal device including a layer of liquid crystal, a pair of substrates disposed to sandwich the liquid crystal, and a polarizer disposed on at least one of the substrates, at least one of the substrates being provided with an alignment film for aligning the liquid crystal in contact therewith, the pair of substrates respectively having thereon mutually intersecting electrodes for applying a voltage to the liquid crystal thereby forming a matrix of pixels each at an intersection of the electrodes on the pair of substrate, a light source provided to one of the substrates for emitting light to be optically modulated by the liquid crystal device, and control means for effecting a plurality of illuminating operations including at least a first operation for displaying a first image by turning the light source on at a first illuminance and a second operation for displaying a second image substantially identical to the first image by turning the light source on at a second illuminance, said first and second illuminances being non-zero and different from each other.

The present invention provides a liquid crystal apparatus, comprising:

a liquid crystal device including a layer of liquid crystal, a pair of substrates disposed to sandwich the liquid crystal, and a polarizer disposed on at least one of the substrates, at least one of the substrates being provided with an alignment film for aligning the liquid crystal in contact therewith, the pair of substrates respectively having thereon mutually intersecting electrodes for applying a voltage to the liquid crystal thereby forming a matrix of pixels each at an intersection of the electrodes on the pair of substrate, and voltage application means for applying a voltage to the liquid crystal through the electrodes, wherein the liquid crystal has an alignment characteristic such that the liquid crystal is aligned to provide an average molecular axis to be placed in a monostable alignment state under no voltage application, is tilted from the monostable alignment state in one direction when supplied with a voltage of a first polarity at a tilting angle which varies depending on magnitude of the supplied voltage, and is tilted from the monostable alignment state in the other direction when supplied with a voltage of a second polarity opposite to the first polarity at a tilting angle, said tilting angles providing maximum tilting angles formed under application of the voltages of the first and second polarities, respectively, different from each other.

The present invention also provides a liquid crystal apparatus, comprising:

a liquid crystal device including a layer of liquid crystal, a pair of substrates disposed to sandwich the liquid crystal, and a polarizer disposed on at least one of the substrates, the pair of substrates respectively having thereon mutually intersecting electrodes for applying a voltage to the liquid crystal thereby forming a matrix of pixels each at an intersection of the electrodes on the pair of substrate, and a drive circuit for driving the liquid crystal device to effect desired gradational display based on change in emitting light quantity for each pixel, wherein each pixel is supplied with a driving signal from said drive circuit, said driving signal including in a first period a voltage of a first polarity for providing a prescribed light quantity equal to or larger than a light quantity for providing a prescribed gradational image and in a second period a voltage of a second polarity opposite to the first polarity for providing a second light quantity smaller than the prescribed light quantity but larger than zero, thereby to effect desired gradational display through the first and second period.

The present invention further provides a driving method for a display apparatus wherein a plurality of color lights are successively emitted from a color light source and in synchronism with the respective light emissions, switching of the respective lights is effected by a display device to visually color-mixing the respective lights to provide a full-color image, said driving method comprising:

dividing one frame period into a plurality of field periods and further dividing each field period into a plurality of sub-field periods, changing a color of a light emitted from the color light source for each field period, and displaying a higher luminance image in at least one sub-field period in each field period and a lower luminance image in at least one another sub-field period in each field period.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 4A, 4BA, 4BB, 4CA and 4CB are illustrations of alignment states of liquid crystal molecules in an embodiment of a liquid crystal device used in the present invention, wherein FIG. 4A shows a course of smectic layer formation of liquid crystal molecules exhibiting a phase transition series of Ch-SmC* in a chevron structure or an oblique bookshelf structure, FIGS. 4BA and 4CA are plan views showing alignment states of liquid crystal molecules having a chevron structure in a C1 alignment and a C2 alignment, respectively, and FIGS. 4BB and 4CB are corresponding positions of liquid crystal molecules and C-directors in the alignment states shown in FIGS. 4BA and 4CA, respectively.

FIGS. 6AB, 6BB and 6CB are corresponding positions of liquid crystal molecules and C-directions in the alignment states shown in FIGS. 6AA, 6BA and 6CA, respectively.

DESCRIPTION OF THE PREFERRED EMBODIMENTS

Figure 1A:
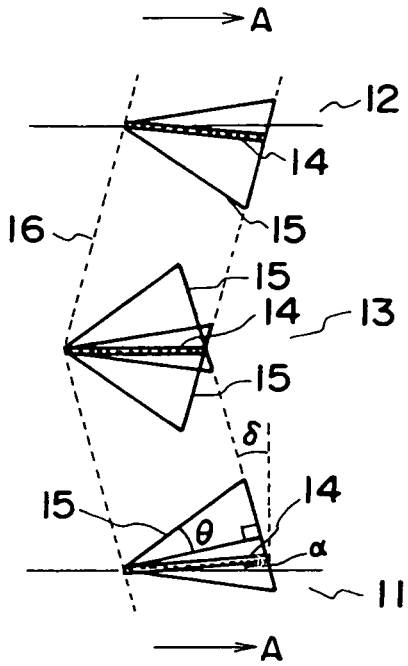
FIGS. 1A an 1B are illustrations of liquid crystal molecules and a smectic layer structure formed thereby in C1 alignment and C2 alignment, respectively, in an SSFLC-type device.

Hereinbelow, some preferred embodiments of the (liquid crystal) display apparatus and the driving method therefor according to the present invention will be described specifically with reference to the drawings.

First Embodiment

In the display device used in the present invention according to this embodiment, a plurality of displaying operations per second at each pixel for the display device are effected by a control means constituting a display apparatus of the present invention in combination with the display device.

The plurality of displaying operations includes at least a first operation for displaying a first image at a (non-zero) higher luminance (first luminance) and a second operation for displaying a second image substantially identical to the first image at a (non-zero) lower luminance (second luminance), thus providing a human-sensible high-speed motion picture image without largely impairing a luminance or brightness of the resultant display device.

The display device used in the present invention may include a display device of a type wherein an image display is performed by optical modulation of external light and a self-emission type display device, such as an EL (electroluminescent) display device or a plasma display device.

In the present invention, the display device may particularly preferably be a liquid crystal (display) device including a pair of oppositely disposed substrates each provided with an electrode for applying a voltage to a liquid crystal and at least one of which is subjected to a uniaxial aligning treatment at its opposing (inner) surface and is provided with a polarizer and including a liquid crystal disposed between the opposing surfaces of the pair of substrates.

In this embodiment, in the (liquid crystal) display device, the lower (second) luminance in the second operation may preferably be at most ⅕ of the higher (first) luminance in the first operation. Particularly, in the liquid crystal device, the plurality of displaying operations (optical modulation operations) may preferably be performed such that a first optical modulation operation is performed to provide a first transmittance (passing through the device) corresponding to the first luminance for displaying the first image in a first display (sub-)field period and a second optical modulation operation is performed to provide a second transmittance which is non-zero and at most ⅕ of the first transmittance in a second display (sub-)field period.

In this embodiment, the (liquid crystal) display apparatus using the liquid crystal device may further include an external light source as a backlight (e.g., a white light source or a color light source) disposed outside one of the pair of substrates of the liquid crystal device. In this display apparatus, the liquid crystal device is illuminated with the light source at a first illuminance in at least one display (sub-)field period constituting one frame period and at a second illuminance which is non-zero and smaller than the first illuminance in at least one another (different) display ((sub-)field) period, thus effecting the above-mentioned plurality of displaying operations.

The second illuminance may preferably be at most ⅕ of the first illuminance.

Another driving method for such a display apparatus based on illuminance control of a color light source will be described with reference to FIGS. 15 and 21 in combination with FIGS. 11 and 12.

Figure 15:
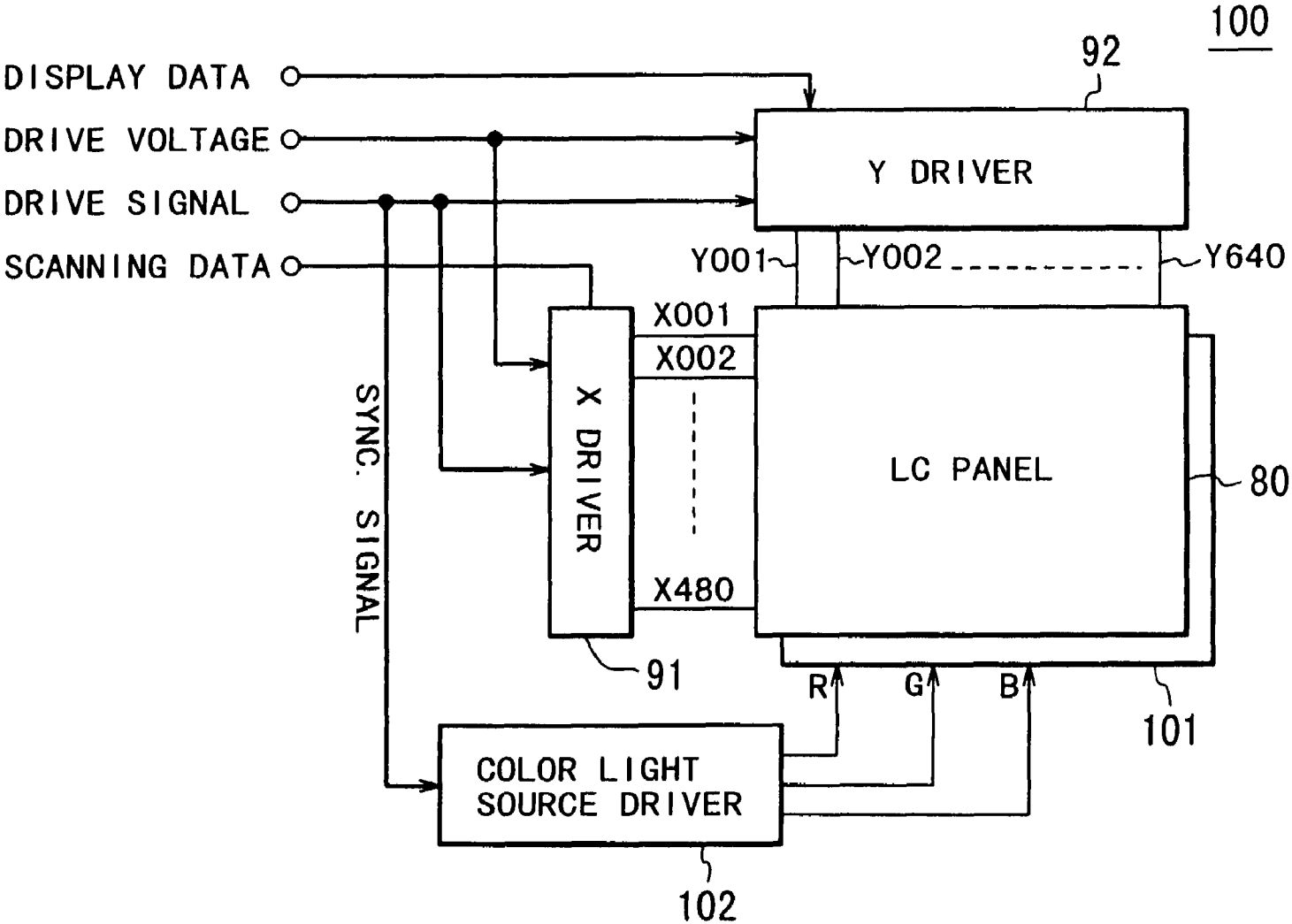
FIGS. 15 and 19 are block diagrams of embodiments of the liquid crystal apparatus according to the present invention and a conventional liquid crystal apparatus, respectively.
Figure 19:
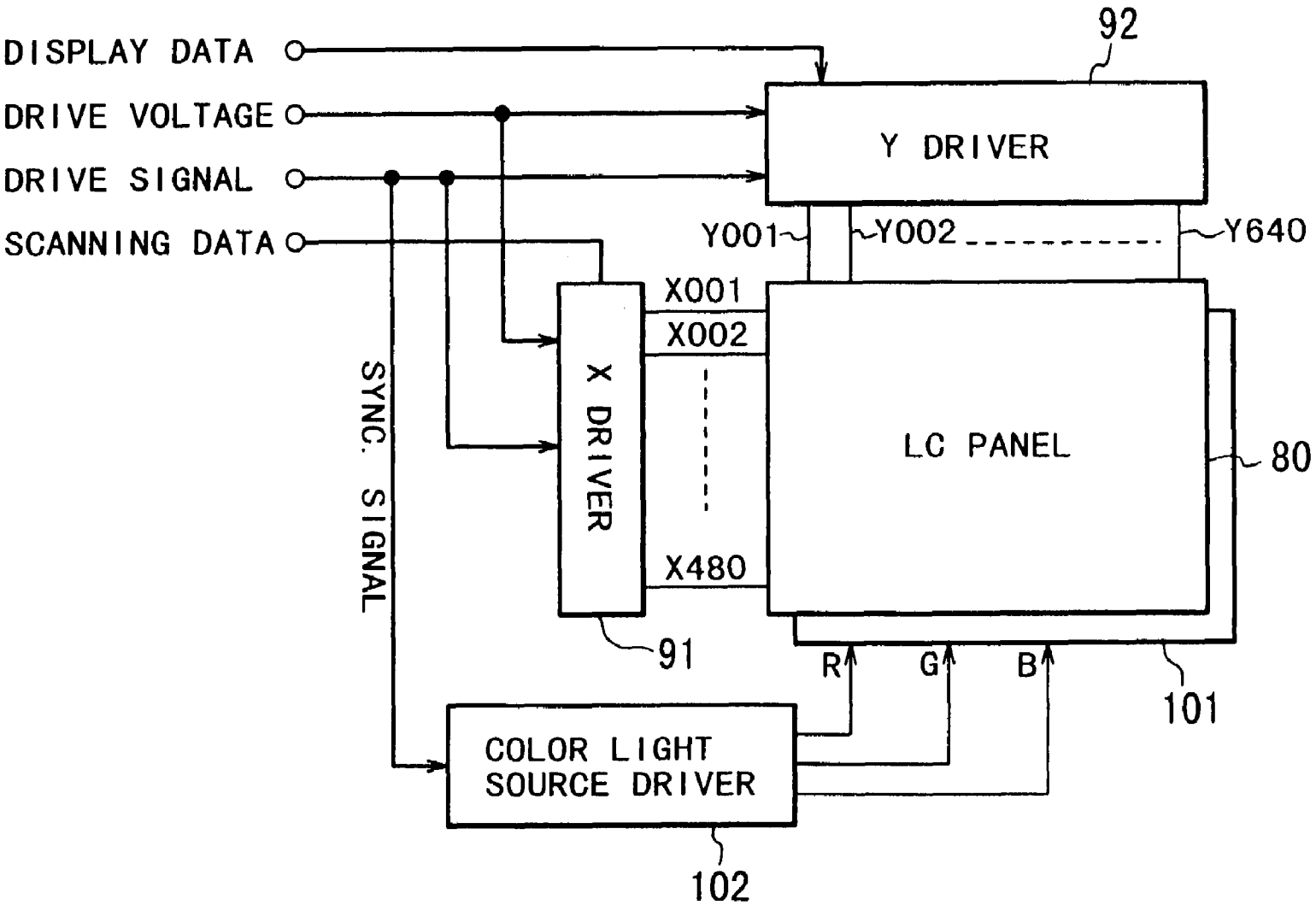

FIG. 15 is a block diagram of a liquid crystal display apparatus 100 including a color light source 101 according to the present invention. The display apparatus has a structure identical to that of the conventional display apparatus shown in FIG. 19.

Figure 21:
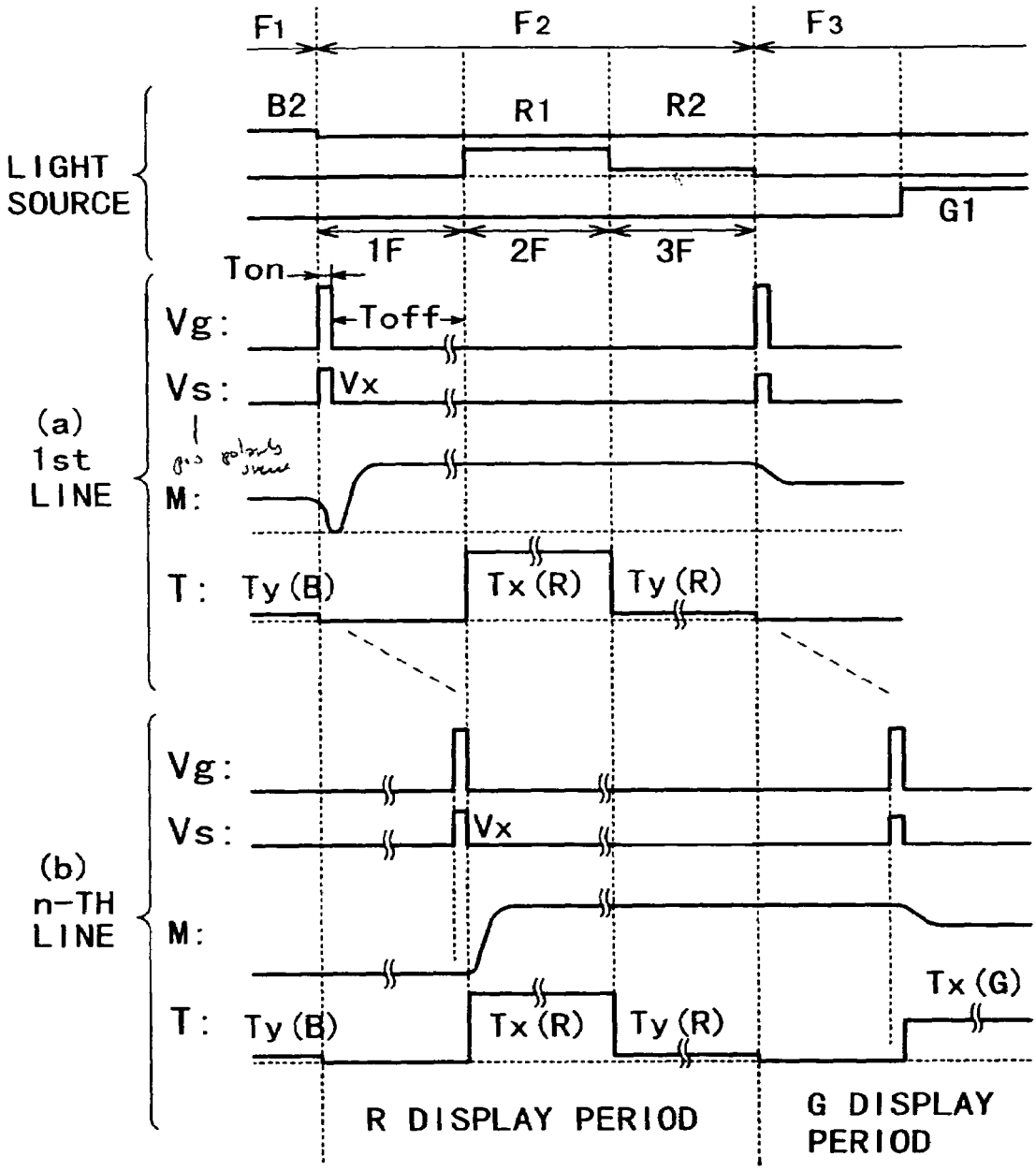

The display apparatus 100 of the present invention is driven by a driving method based on illuminance control as shown in FIG. 21.

More specifically, referring to FIG. 21, when light source lights issued from the color light source 101 are lights of red (R), green (G) and blue (B), one frame period F0 is divided into three (first to third) field periods F1, F2 and F3 for emitting lights of R, G and B, respectively. Each of the field periods F1, F2 and F3 is further divided into three (firsts to third) sub-field periods 1F, 2F and 3F. In the first sub-field period 1F (of each of the field periods F1, F2 and F3), the color light source 101 is turned off. Then, the color light source 101 is turned on in the second sub-field period 2F at a first illuminance so as to provide a prescribed color light (e.g., red (R) in FIG. 21) (R1 illumination) and in the third sub-field period 3F at a second illuminance, which is non-zero and smaller than the first illuminance, so as to provide the same color light (R2 illumination), thus displaying a higher luminance (red) image in the second sub-field period 2F and a lower luminance (red) image in the third sub-field period 3F.

The thus-displayed color images different in color in the three field periods F1, F2 and F3, respectively are visually color-mixed to be recognized as a full-color image in each frame period F0.

The number of the field periods may be changed depending on the number of light-source lights issued from the color light source 101. For example, when four colors (of red (R), green (G), blue (B) and white (W)) are employed as the light-source light, one frame period F0 may b divided into four field periods F1, F2, F3 and F4.

In the above driving method, the order of light illumination is set to B, R and G. However, the light illumination order may be appropriately changed in any order (e.g. the order of R, G and B) within one frame period.

Figure 11:
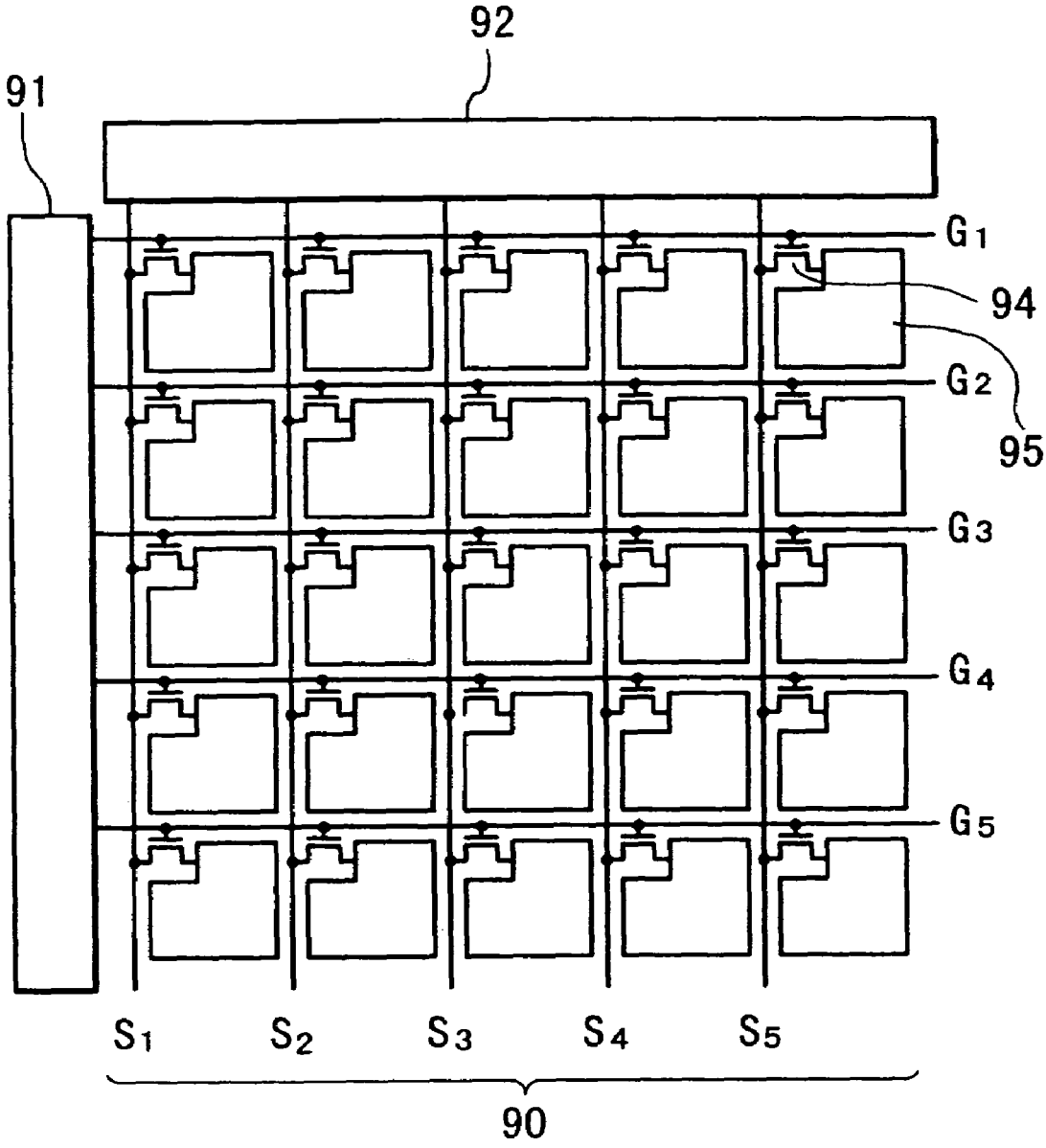
FIG. 11 is a schematic plan view of an embodiment of an active matrix-type liquid crystal device applicable to the present invention in combination with drive circuits therefor.
Figure 12:
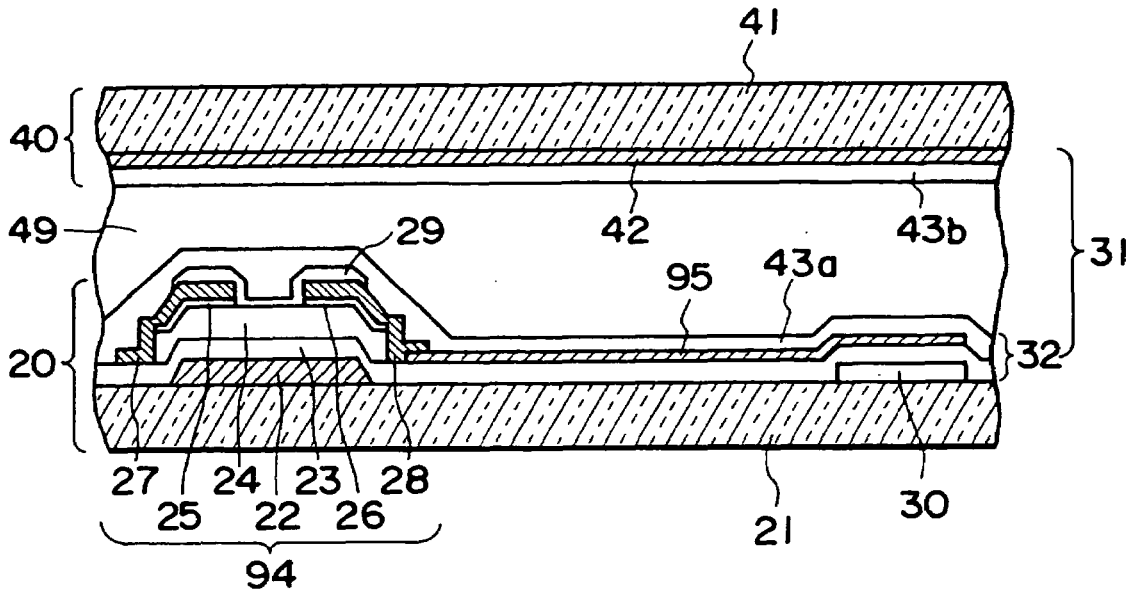
FIG. 12 is an enlarged sectional view showing each pixel portion of the liquid crystal device shown in FIG. 11.

In the above driving method, the liquid crystal device 80 is of an active matrix-type as shown in FIGS. 11 and 12.

The driving method will be described more specifically based on FIG. 21 in combination with FIGS. 11 and 12.

Referring to these figures, in the first sub-field period 1F of the second field period F2, any one of gate lines G1, G2, . . . Gn (e.g., i-th gate line Gi) is supplied with a gate voltage Vg in a prescribed period (selection period Ton). In synchronism with the gate voltage application, any one of source lines S1, S2, . . . , Sn (e.g., j-th source line Sj) is supplied with a source voltage Vs (=Vx) in the selection period Ton relative to a potential Vc (not shown) of a common electrode 42 taken as a reference potential. In this instance, a TFT (thin film transistor) 94 on a pixel concerned along with the gate and source lines Gi and Sj is turned on by the application of the gate voltage Vg and the pixel is electrically charged by the application of the source voltage Vx via the TFT 94 and a pixel electrode 95 at a liquid crystal capacitor C1*c* and a holding (supplementary) capacitor Cs.

In a non-selection period Toff (other than Ton) in the first sub-field period 1F of the second field period F2, the gate voltage Vg is not applied to the gate line Gi but is applied to other gate lines G1, G2, . . . , Gn (other than Gi), thus turning the TFT 94 off. As a result, the liquid crystal capacitor C1*c* and the holding capacitor Cs retains the charges (stored in the selection period Ton) through the non-selection period Toff, whereby a liquid crystal 49 is continuously supplied with a pixel voltage Vpix (=Vx) through the entire second field period F2, thus continuously retaining liquid crystal molecules in a substantially identical position (through the entire second field period F2).

Similarly, scanning (selection of the gate lines) is continued to the last gate line Gn in the first sub-field period 1F (of the second field period F2) wherein all the liquid crystal molecules are maintained in a prescribed alignment state. In the first sub-field period 1F, the color light source 101 is turned off, thus resulting in a transmitted light quantity (T) of zero. If the color light source 101 is continuously turned on, a resultant transmitted light quantity (T) is changed as shown at M of FIG. 21 depending on respective color light transmittances.

Then, the color light source 101 is turned on at a first illuminance in a subsequent second sub-field period 2F and at a second illuminance lower than the first illuminance but larger than zero in a third sub-field period 3F subsequent to the second sub-field period 2F, thus attaining a transmitted light quantity Tx in the second sub-field period 2F and a transmitted light quantity Ty in the third sub-field period 3F, respectively. As a result, in the entire second field period F2, an average transmitted light quantity of zero, Tx and Ty is obtained.

In this instance, in the second field period F2, the liquid crystal device 80 is illuminated with the color light source 101 emitting red light, whereby a black-and-white (monochrome) image displayed on the liquid crystal device is recognized as a red image. Similarly, in the previous (first) field period F1, a black-and-white image is recognized as a blue image by blue light illumination. In the subsequent (third) field period F3, a black-and-white image is recognized as a green image by green light illumination. As a result, these color images are visually color-mixed to be recognized as a full-color image in the entire (one) frame period consisting of the three field periods F1, F2 and F3.

In this embodiment, the source voltage applied to the source line Sj may preferably be changed in its polarity frame by frame (frame inversion driving scheme), whereby the liquid crystal 49 is supplied with a positive-polarity source voltage Vx and a negative-polarity source voltage −Vx in an alternating manner, thus suppressing a deterioration of the liquid crystal 49.

Figure 7:
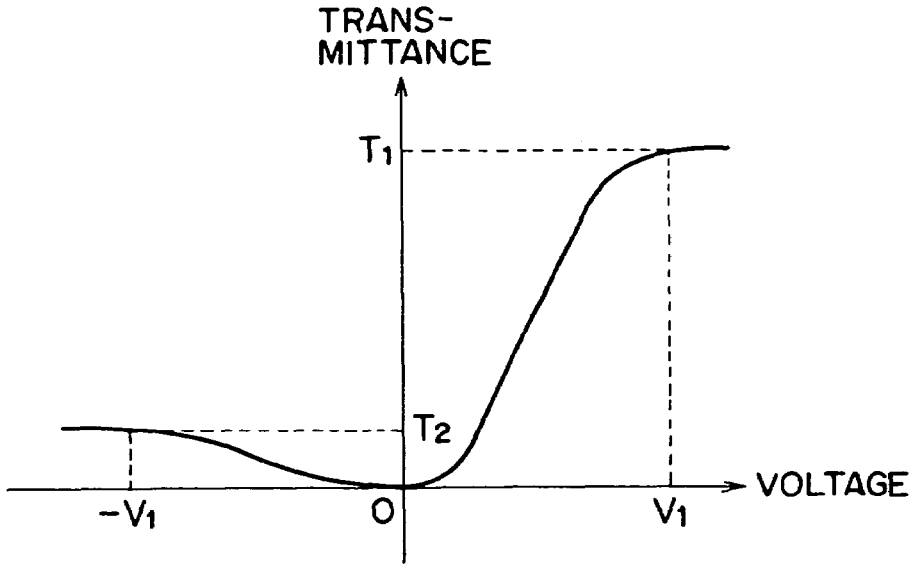
FIG. 7 is a graph showing an example of a V-T (voltage-transmittance) characteristic of a liquid crystal device used in the present invention.
Figure 22:
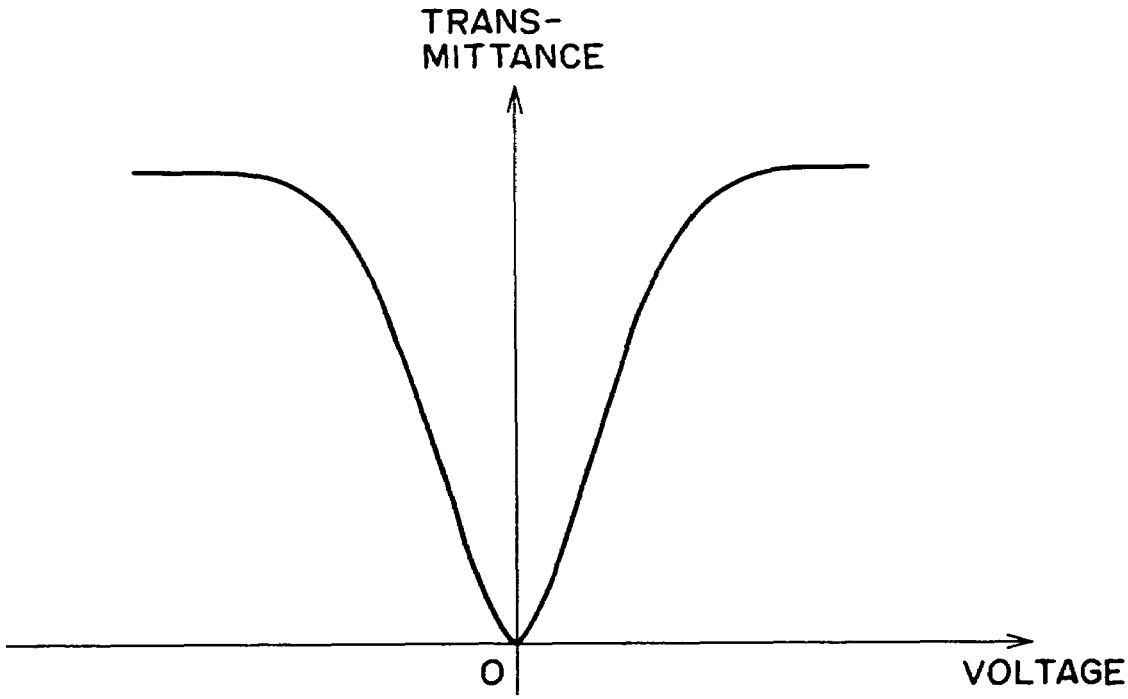
FIG. 22 is a graph showing another embodiment of a V-T characteristic of a liquid crystal device used in the present invention.

In the case where such a frame inversion driving scheme is adopted in combination with the illuminance control of the color light source as shown in FIG. 21, the liquid crystal 49 used may be not only one exhibiting voltage-transmittance (V-T) characteristic as shown in FIG. 7 but also one exhibiting a V-T characteristic as shown in FIG. 22, thus allowing a more latitude in selection of a liquid crystal material.

As the liquid crystal device 80 more suitable for this embodiment effecting display based on the setting of the first and second luminances (illuminances) as described above, a liquid crystal device using a chiral smectic liquid crystal assuming a monostable state under no voltage application, particularly as described in JP-A 10-177145 is used.

Hereinbelow, a liquid crystal assuming chiral smectic phase suitably used as the liquid crystal 49 of the liquid crystal device 80 used in the present invention will be described in terms of an alignment state in chiral smectic phase and a switching behavior of its liquid crystal molecules by contrast with the above-mentioned conventional SSFLC with reference to FIGS. 1-8.

In FIGS. 1-8, the alignment state and switching behavior are explained based on typical molecular models representing relationships between liquid crystal molecules and virtual cone (defining a position of liquid crystal molecules), a normal to a smectic (molecular) layer and an average uniaxial aligning treatment axis. The liquid crystal molecules are present between a pair of substrates and twisted in a direction of a normal to the substrates. The behavior of the liquid crystal molecules is optically observed (e.g., through a polarizing microscope) as that of an average molecular axis. Accordingly, the average molecular axis defined in the present invention corresponds to a single liquid crystal molecule.

In the conventional SSFLC-type device using a liquid crystal assuming chiral smectic C phase (SmC*), liquid crystal molecules are stabilized in (either one of) two (optically) stable states, thus developing a bistability or a memory characteristic. First, this memory state will be described with reference to FIGS. 1 and 2.

Figure 1B:
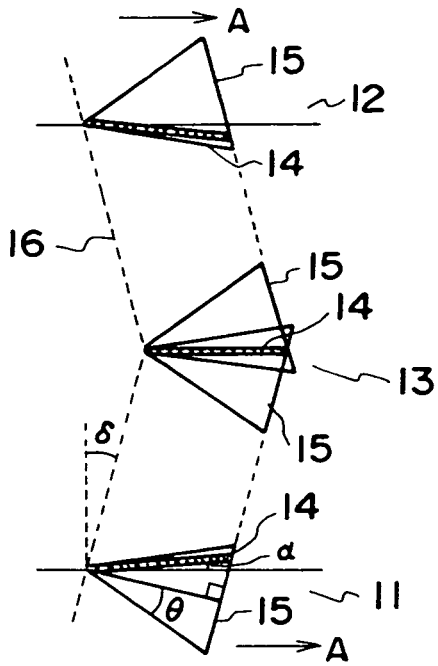

FIGS. 1A and 1B are schematic illustrations of liquid crystal molecules and a smectic (molecular) layer structure formed thereby in the SSFLC-type device.

Referring to FIGS. 1A and 1B, a liquid crystal 13 sandwiched between a pair of parallel substrates 11 and 12 includes a plurality of liquid crystal molecules 14. The liquid crystal molecules 14 in the vicinity of boundaries with the substrates form a pretilt angle $\alpha$, the direction of which is such that the liquid crystal molecules 14 raise a forward end up (i.e., spaced from the substrate surface) in the directions of uniaxial aligning treatment indicated by arrows A, respectively. I these figures, the uniaxial aligning treatment axis directions A of the pair of substrates 11 and 12 are parallel to each other and in an identical direction. Between the pair of substrates 11 and 12, the liquid crystal molecules 14 form each smectic (molecular) layer 16 having a chevron structure where the smectic layer 16 is bent at a mid point between the substrates (hereinbelow, referred to as a "bending point") and provides a layer inclination angle $\delta$ with respect to a normal to the substrates. These liquid crystal molecules 14 cause switching between two stable states under electric field application and under no electric field application, are stably present at a wall surface of a virtual cone 15 having an apex angle 2 Ⓗ (Ⓗ: a cone angle intrinsic to the liquid crystal material used).

As shown in FIGS. 1A an 1B, the liquid crystal 13 between the substrates 11 and 12 can assume different two alignment states depending on the pretilt directions of the liquid crystal molecules 14 in the vicinity of the substrate surface and the bending directions of the chevron structures of the smectic layers 16 between the substrates 11 and 12. Herein, the alignment state shown in FIG. 1A is referred to as a "C1 alignment (state)" and the alignment state shown in FIG. 1B is referred to a a "C2 alignment (state)", respectively.

In both the C1 and C2 alignment states, all the liquid crystal molecules 14 can assume two (optically) stable states within the cone 15 in a thickness direction between the substrates of the device including the bending points under no electric field application by generally satisfying a relationship of Ⓗ>$\delta$, thus realizing bistable states.

Figure 2A:
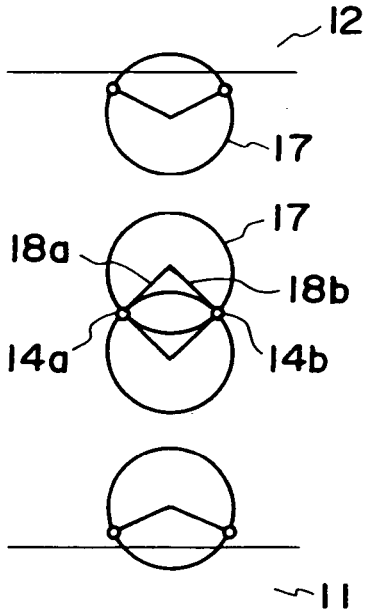
FIGS. 2A and 2B are illustrations of positions of C-directors in the C1 alignment shown in FIG. 1A and the C2 alignment shown in FIG. 1B, respectively.
Figure 2B:
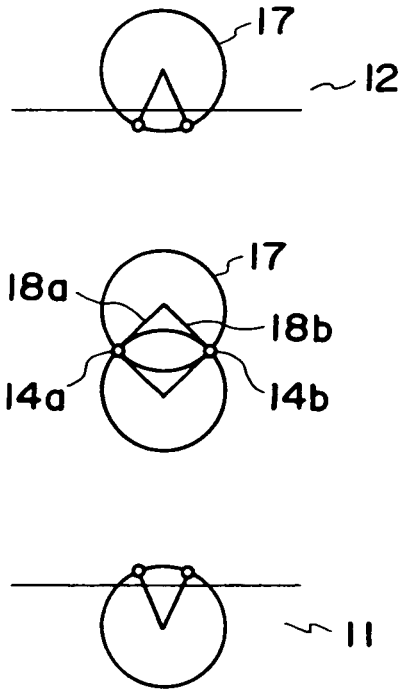

FIGS. 2A and 2B are views for illustrating positions of C-directors (projections of the liquid crystal molecules on a circular base 17 of the virtual cone 15) in the C1 alignment shown in FIG. 1A and the C2 alignment shown in FIG. 1B, respectively.

Referring to FIGS. 2A and 2B, each of the liquid crystal molecules may assume bistable states 14*a* and 14*b* (projections 18*a* and 18*b*) at any position between the substrates 11 and 12.

In the above (SSFLC-type) device wherein the liquid crystal assumes a bistability (bistable alignment states), a pair of polarizers-are disposed so that one of the polarizers is aligned with one of two average molecular axes (molecular positions) providing the two (optically) stable states, thus effecting a switching between the two stable states (bistable states) to allow a black (dark) and white (bright) display. In this case, the switching (between the two stable states) is performed through formation of a domain of one of the two stable states from the other stable state, i.e., is accompanied with formation and extinction of domain walls.

In the case of effecting display based on such a switching mechanism, the display is basically a two-value display providing a black display state and a white display state. Accordingly, it is difficult to effect a gradation (halftone) display between the black and white display state.

On the other hand, in the liquid crystal device used in the present invention, a liquid crystal material used is selected so that it does not exhibit the memory characteristic (bistability) as illustrated in FIGS. 1 and 2 and can continuously change its molecular position depending on a voltage applied thereto, in order to realize gradational display by the liquid crystal device using a liquid crystal material assuming chiral smectic phase. For this reason, in the present invention, the liquid crystal material used may preferably be a liquid crystal material exhibiting a phase transition series of Iso. (isotropic liquid phase)-Ch (cholesteric phase)-SmC* (chiral smectic C phase) or of Iso.-SmC* on temperature decrease.

Figure 3A:
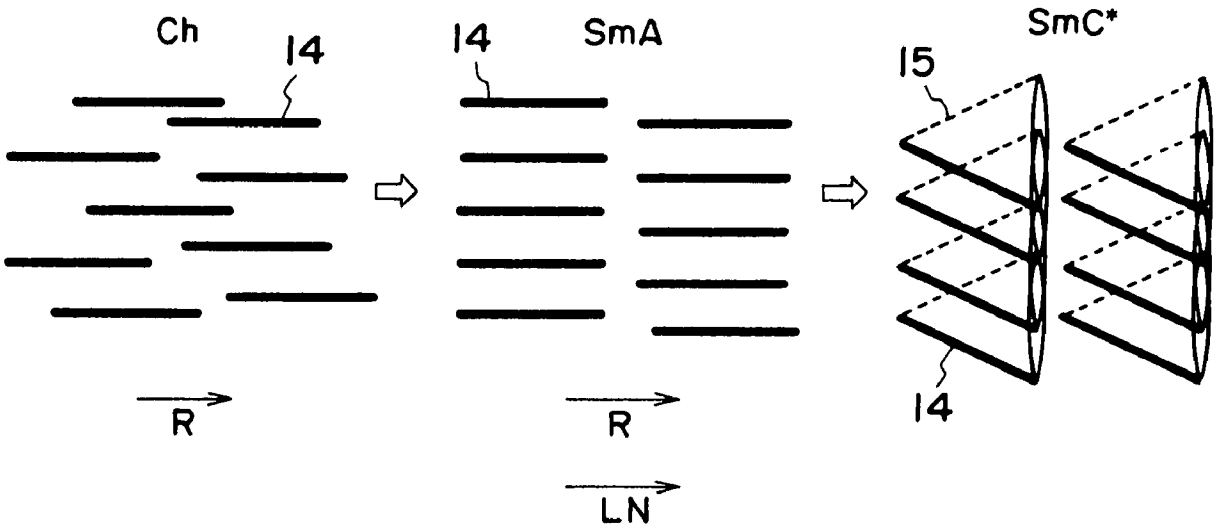
FIGS. 3A and 3B are illustrations of courses of smectic layer formation of liquid crystal molecules exhibiting a phase transition series of Ch (cholesteric phase)-SmA (smectic A phase)-SmC* (chiral smectic C phase) in an SSFLC-type device and a phase transition series of Ch-SmC* in an embodiment of a liquid crystal device used in the present invention, respectively.
Figure 3B:
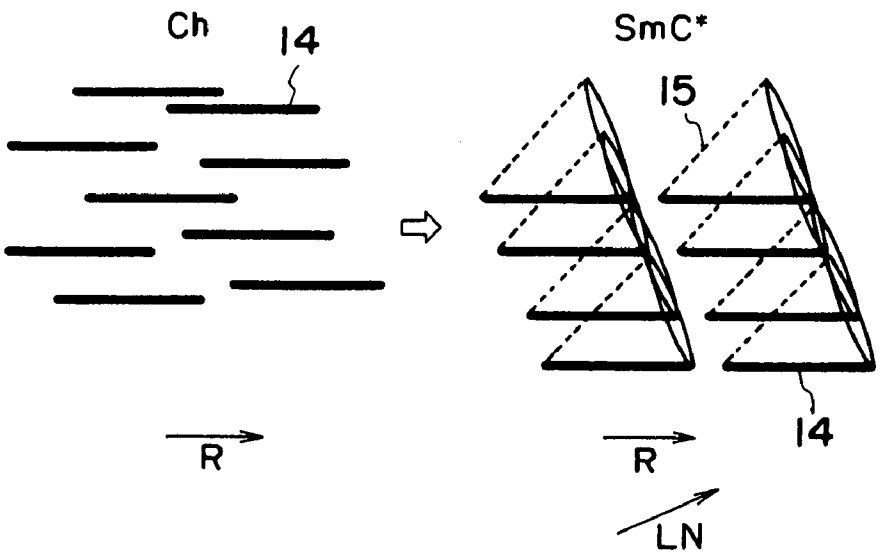

FIG. 3A shows a course (process) of formation of smectic layer structure of a liquid crystal material exhibiting a phase transition series on temperature decrease of at least Ch-SmA (smectic A phase)-SmC* and FIG. 3B shows a course of smectic layer structure formation of a liquid crystal material exhibiting at Ch-SmC* phase transition. series on temperature decrease.

In these figures, an arrow R represents a direction of an average uniaxial aligning treatment axis and an arrow LN represents a direction of a normal to smectic layer (layer normal direction). Further, the liquid crystal molecules 14 can effect switching along with the wall surface of the virtual cone 15 at the time of voltage application thereto.

Herein, a direction of the "average uniaxial aligning treatment axis" means a direction of a uniaxial aligning treatment axis direction in the case where only one of the pair of substrates is subjected to a uniaxial aligning treatment or a direction of two parallel uniaxial aligning treatment axes in the case where both of the pair of substrates are subjected to a uniaxial aligning treatment so that their uniaxial aligning treatment axes are parallel to each other and in the same direction or opposite directions (parallel relationship or anti-parallel relationship). Further, in the case where both of the substrates are subjected to a uniaxial aligning treatment so that their uniaxial aligning treatment axes intersect each other at a crossing angle, the "average uniaxial aligning treatment axis" direction means a direction of a bisector of the uniaxial aligning treatment axes (a half of the crossing angle).

Referring to FIG. 3A, in the case of the liquid crystal material having the phase transition series including SmA (smectic A phase), the liquid crystal molecules 14 are oriented in SmA so that the (smectic) layer normal direction LN is aligned with the uniaxial aligning treatment direction R, thus forming a smectic layer structure. In SmC*, the liquid crystal molecules 14 are tilted from the layer normal direction LN and stabilized at a position in the vicinity of or slightly inside an edge of the virtual cone 15.

On the other hand, in the case of the liquid crystal material having the SmA-less phase transition series suitably used in the present invention, as shown in FIG. 3B, the liquid crystal molecules 14 are oriented in the phase transition from Ch to SmC* so that they are tilted from the layer normal direction LN and also slightly tilted from the average uniaxial aligning treatment axis direction, thus forming a smectic layer structure.

In, the present invention, the liquid crystal material used is controlled so that the liquid crystal molecules 14 are stabilized at a position (slightly) inside the edge of the virtual cone 15 in an operation temperature range in SmC* to form a smectic layer structure having a chevron structure or an oblique bookshelf structure (where smectic layers are uniformly tilted from a direction of a normal to the substrates) providing a prescribed layer inclination angle.

In the case of a smectic layer structure having a complete bookshelf structure, the liquid crystal molecules 14 an also be stabilized inside the virtual cone edge in some cases including a case of a high pretilt angle or a case where liquid crystal molecules in a bulk state are twisted due to a strong polar interaction at a boundary with a substrate.

In the case where a liquid crystal material has a remarkable electroclinic effect, the liquid crystal molecules are tilted outside the virtual cone edge under application of an electric field. Such a liquid crystal material having the electroclinic effect is also applicable to the present invention since in the liquid crystal device used in the present invention, a deviation angle between the (liquid crystal) molecular orientation direction and the layer normal direction under electric field application is larger than a deviation angle therebetween under no electric field application. Specifically, when one of polarizing axes of cross-nicol polarizers is aligned with the liquid crystal molecular direction under no electric field application to provide a darkest state, an optical axis of the liquid crystal material used is deviated from the polarizing axis in either case of a positive-polarity voltage application and a negative-polarity voltage application, thus realizing birefringence.

Next, as an example of the liquid crystal material usable in the present invention, a liquid crystal material having a chevron or oblique bookshelf structure providing a layer inclination angle will be described with reference to FIG. 4.

Figure 4A:
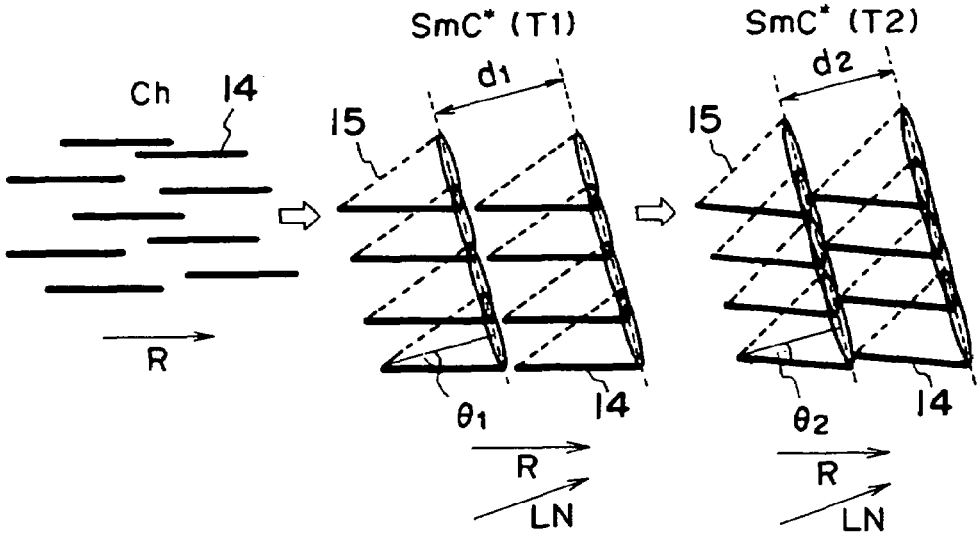

FIG. 4A shows a course of smectic layer structure formation of liquid crystal molecules assuming a phase transition series free from SmA similarly as in FIG. 3B.

Referring to FIG. 4A, the smectic layer structure is formed in the course of phase transition from Ch to SmC* (particularly, at a temperature immediately below a phase transition temperature from Ch to SmC*) wherein the liquid crystal molecules 14 are oriented or aligned so that they are tilted from the smectic layer normal direction LN.

In such a smectic layer structure formation, however the cone angle Ⓗ (half of an apex angle of the virtual cone 15) is different, e.g., between a higher-temperature state (T1) and a lower-temperature state (T2) within SmC*-temperature range.

When a cone angle Ⓗ1 in the higher-temperature state (T1) and a cone angle Ⓗ2 in the lower-temperature state (T2) of a liquid crystal material used is set so as to satisfy a relationship: Ⓗ1<Ⓗ2, in an ordinary case, a layer spacing d1 in T1 and a layer spacing d2 in T2 hold a relationship: d1>d2.

Accordingly, if the liquid crystal material has a bookshelf structure in T1, the liquid crystal material in T2 provides a layer inclination angle δ at least satisfying an equation: $\delta=\cos^{-1}(d2/d1)$. As a result, in T2, the liquid crystal molecules of the liquid crystal material form a chevron or oblique bookshelf structure. Of these structures, the chevron structure will be described.

Figure 4B:
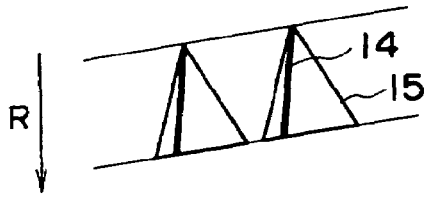
Figure 4C:
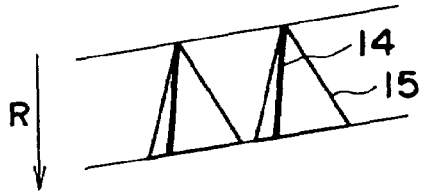
Figure 4B:
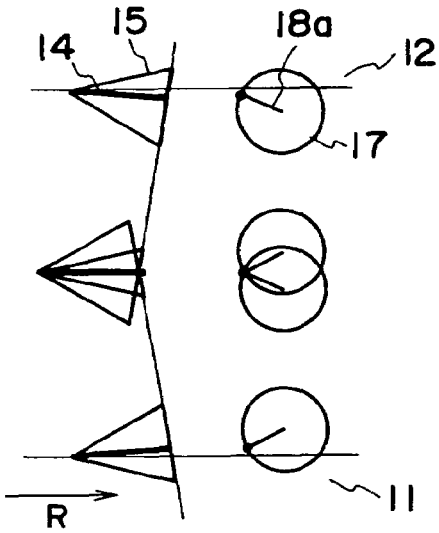
Figure 4C:
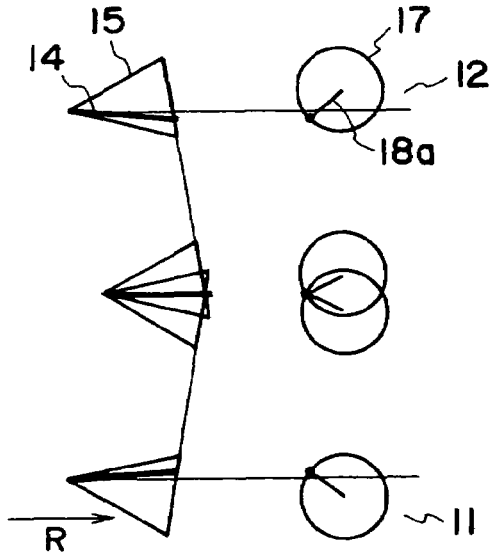

Layer structures and positions of C-directors of a liquid crystal material having a chevron structure are shown in FIGS. 4BA-4CB, wherein FIG. 4BA is a plan view showing a layer structure of liquid crystal molecules 14 in C1 alignment and FIG. 4BB is a corresponding sectional view showing the layer structure and positions of C-directions of the liquid crystal molecules 14 in C1 alignment and FIGS. 4CA and 4CB are those in C2 alignment, respectively.

In these figures, the identical reference numerals and symbols have the same meanings as in FIGS. 1 and 2.

As shown in these figures, the liquid crystal material having the chevron structure is controlled so that the liquid crystal molecules 14 are stabilized inside the edge of the virtual cone 15 based on the above-described relationships.

In all the cases shown in FIGS. 3A, 3B and 4A, the liquid crystal molecules 14, e.g., as shown in FIGS. 1A to 2B may be considered to be stabilized in a bistable alignment state in the chevron (layer) structure, i.e., in two stable states where the liquid crystal molecules are substantially parallel to the substrates 11 and 12. However, in the cases shown in FIGS. 3B and 4A, a constraint force becomes larger due to the uniaxial aligning treatment. As a result, only one of these two stable states is stabilized, whereby a memory characteristic (bistability) of the liquid crystal material is lost.

Figure 5:
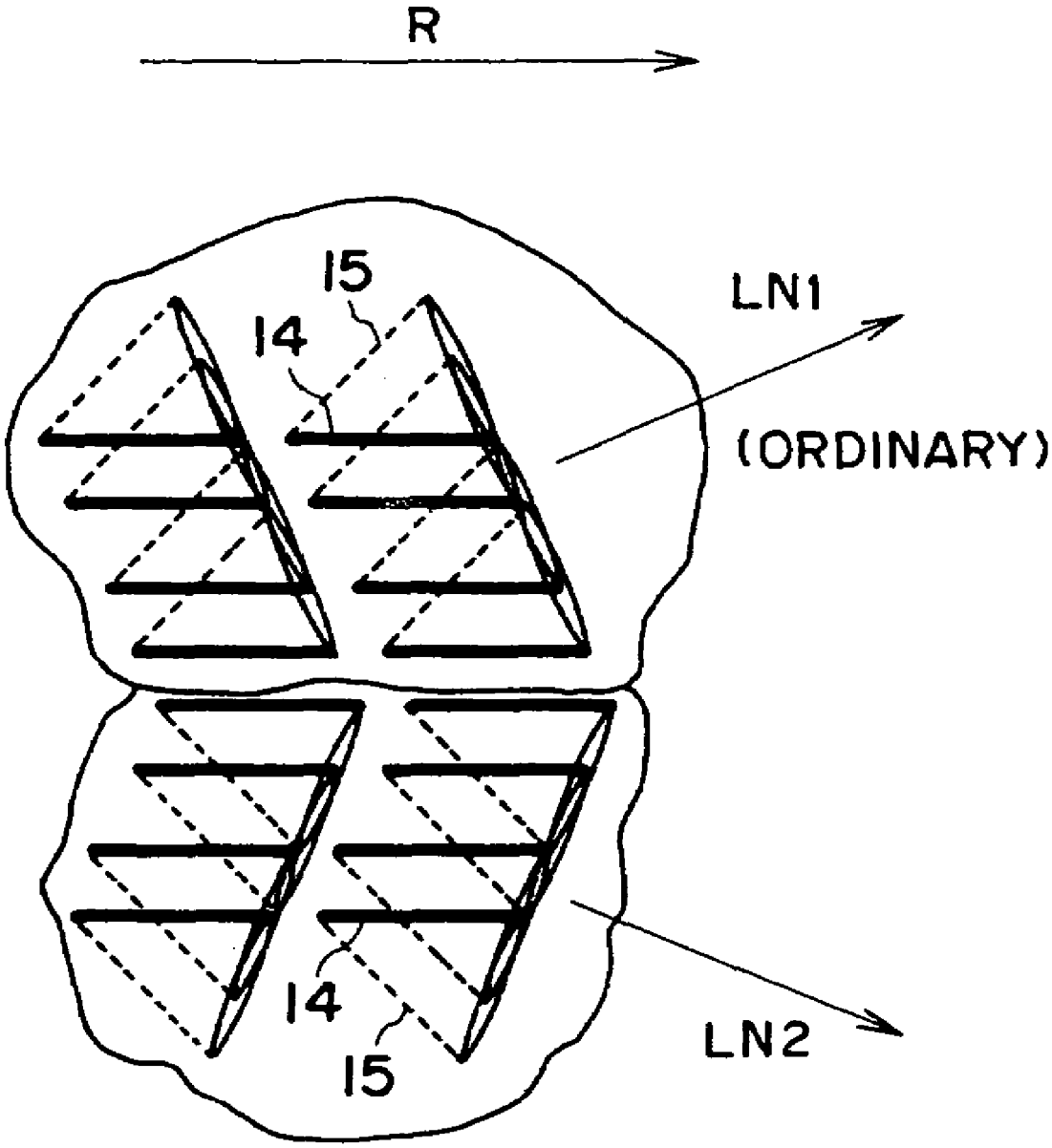
FIG. 5 is a schematic view showing an alignment state of liquid crystal molecules in chiral smectic C phase.

Further, it may be assumed that the liquid crystal molecules 14 form two smectic layer structures providing different layer normal directions LN1 and LN2 as shown in FIG. 5 at the time of the phase transition from Ch to SmC*, i.e., at a temperature immediately below the phase transition temperature from Ch to SmC*, as shown in FIGS. 3B and 4A. In this instance, if the pair of substrates between which the (chiral smectic) liquid crystal material is disposed are subjected to a completely symmetrical uniaxial aligning treatment, i.e., a uniaxial aligning treatment under identical conditions in terms of a treating direction, an alignment film material, etc., the two (different) smectic layer structures shown in FIG. 5 are formed in an equivalent proportion.

In the liquid crystal device used in the present invention, the layer structure formation of the liquid crystal material used is performed so as to preferentially form only one of the above two smectic layer structures, i.e., is performed so that a direction of deviation of the layer normal direction (LN1 or LN2, ordinarily LN1) from the average uniaxial aligning treatment axis direction R is kept in a certain direction, whereby the liquid crystal molecules 14 are stabilized inside one of two edges of the virtual cone 15 under no voltage application as shown in FIGS. 4BA-4CA, thus attaining a memory-less SmC* alignment state.

Then, an inversion behavior (to an electric field) of liquid crystal molecules placed in such an alignment state that one of the two smectic layer structures shown in FIG. 5 is preferentially formed in a liquid crystal device used in the present invention will be described with reference to FIGS. 6AA to 6D.

In these figures, the liquid crystal device employs a parallel rubbing cell (a pair of substrates subjected to a rubbing treatment (as a uniaxial aligning treatment) so that two rubbing directions are parallel and identical to each other) and the inversion behavior is explained with respect to the liquid crystal molecules in C2 alignment. However, inversion behaviors in the cases of, e.g., C1 alignment, oblique bookshelf structure and anti-parallel rubbing cell can be discussed similarly as in the case shown in FIGS. 6AA-6D as specifically described below.

Figure 6A:
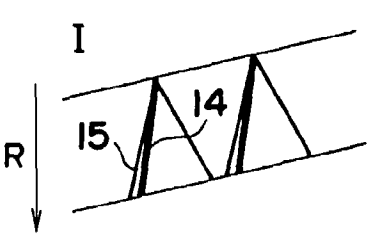
FIGS. 6AA, 6AB, 6BA, 6BB, 6CA, 6CB and 6D are schematic views showing a liquid crystal inversion behavior in chiral smectic C phase under voltage application in an embodiment of a liquid crystal device used in the present invention, wherein FIGS. 6AA, 6BA and 6CA are plan views showing alignment states of liquid crystal molecules in C2 alignment.

FIGS. 6AA, 6BA and 6CA are plan views showing molecular behaviors (I) under application of a positive-polarity electric field (E) (E>0), under no electric field application (E=0) and under application of a negative-polarity electric field (E<0), respectively. FIGS. 6AB, 6BB and 6CB are sectional views showing molecular behaviors (II) corresponding to the molecular behaviors (I) shown in FIGS. 6AA, 6BA and 6CA, respectively, and also showing positions of corresponding C-directions (protections onto a circular base of a virtual cone), respectively.

In FIGS. 6AA, 6BA and 6CA showing the molecular behaviors (I), the liquid crystal molecules 14 are illustrated as an average molecular axis thereof in a direction perpendicular to the substrates.

Figure 6B:
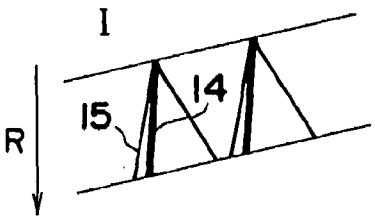
FIG. 6D illustrates an arrangement of a pair of polarizers.

Under no electric field (voltage) application (E=0), s shown in FIG. 6BB, a C-director (projection) 18 on a circular base 17 (of a virtual cone 15) of a liquid crystal molecule 14 is somewhat deviated from an average uniaxial aligning treatment axis direction R, and spontaneous polarizations 18' of the liquid crystal molecules 14 are directed substantially in the same direction between a pair of substrates 11 and 12.

In this instance, when a cell (liquid crystal device) including a pair of polarizers arranged in cross-nicol relationship is disposed so that one of polarizing axes A and P (e.g., polarizing axis P) is aligned with the liquid crystal molecular position (molecular axis) under no voltage application (FIGS. 6BA, 6BB and 6D), a resultant transmitted light quantity passing through the liquid crystal layer is minimized to provide a darkest state (black display state at a first emitting light quantity).

When the liquid crystal molecules 14 placed in the alignment state shown in FIGS. 6BA and 6BB (E=0) are supplied with an electric field (voltage) E, the liquid crystal molecules 14 are tilted (switched) to positions depending on the polarity of the applied voltage E as shown in FIGS. 6AA, 6AB, 6CA and 6CB while having spontaneous polarizations 18 (substantially uniformly directed to a direction of the applied voltage E. An angle of tilting based on the molecular position 14 under no voltage application (E=0) (hereinbelow, referred to as "tilting angle") is increased depending on a magnitude (absolute value) of the applied voltage E. However, as apparent from FIGS. 6AA (E<0) and 6CA (E>0) when compared with FIG. 6BA (E=0), the tilting angle (based on the molecular position under E=0) in the case of application of the positive-polarity (one polarity) voltage (E>0, FIG. 6CA) is largely different from that in the case of application of the negative-polarity (the other polarity) voltage (E<0, FIG. 6AA) even if absolute values of these (positive-polarity and negative-polarity) voltages are identical to each other.

In the case of no voltage application (E=0) as shown in FIG. 6BA, the liquid crystal molecules 14 are (mono-)stabilized in a position which is tilted from the (smectic) layer normal direction. In this instance, when sufficiently larger voltages of positive and negative polarities each having an absolute value further larger than that o the voltage E are applied to the liquid crystal molecules 14, respectively, the respective liquid crystal molecules 14 are further changed in their positions from those shown in FIGS. 6AA and 6CA, respectively, so that the directions of spontaneous polarization of the liquid crystal molecules even in the vicinities of boundaries with the substrates 11 and 12 are also aligned with the directions of electric fields E (E<0, E>0), respectively, similarly as in those of the liquid crystal molecules 14 in a bulk state. As a result, almost all the liquid crystal molecules 14 within the cell are present at the (virtual) cone angles, thus providing (two) maximum tilt states depending on the polarity of the applied voltage based on the molecular position under no voltage application (E=0, FIG. 6BA). As a result, the liquid crystal molecules 14 are placed in a uniform alignment state substantially free from twisting thereof at two extreme molecular positions (on the virtual cone 15) a bisector of which (corr. to the layer normal direction) is a symmetric axis thereof.

In the present invention, as described above, one of the maximum tilt states of the liquid crystal molecules 14 is controlled to be different from the other maximum tilt state, whereby a tilting angle (based on the monostabilized molecular position under E=0) in one maximum tilt state under the positive-polarity voltage application (E>0, FIG. 6CA) becomes larger than that in the other maximum tilt state under the negative-polarity voltage application (E<0, FIG. 6AA).

Figure 6C:
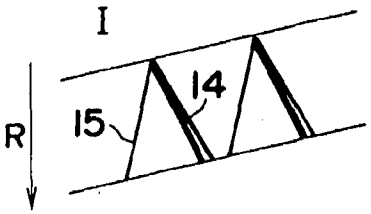
Figure 6A:
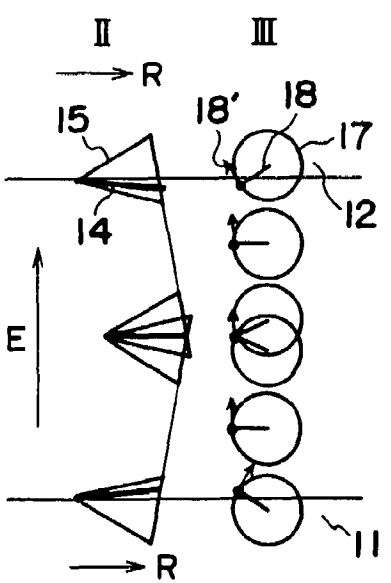
Figure 6B:
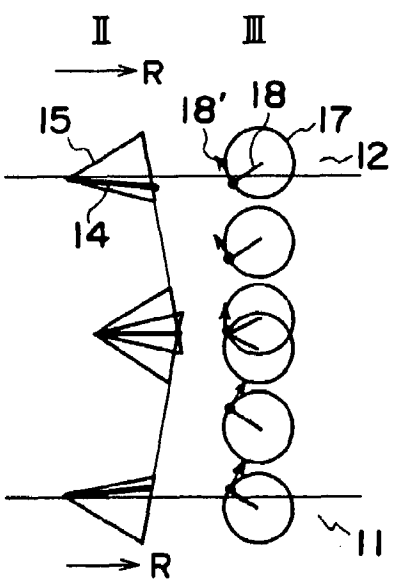
Figure 6C:
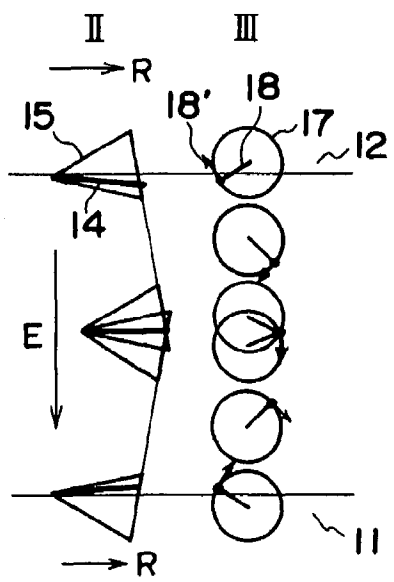

In the case where Δnd (ΔN: refractive index anisotropy; d: cell thickness or thickness of liquid crystal layer) is set to be a value corresponding to ca. ½ of a wavelength of visible light, a positive-polarity voltage application (E>0) as shown in FIG. 6CA provides a prescribed emitting light quantity from the liquid crystal device, i.e., a prescribed tilt state, with an increase in magnitude (absolute value) of the applied voltage E, thus providing a second emitting light quantity most different from the first emitting light quantity under no voltage application (E=0) (within a range of the positive-polarity voltage application), i.e., a maximum transmitted light quantity (in the case of E>0).

On the other hand, as shown in FIG. 6A, a negative-polarity voltage application (E<0) provides an increased transmitted light quantity passing through the liquid crystal device but a degree of optical response corresponding to the transmitted light quantity is considerably lower than the case of E>0 and provides a third emitting light quantity most different from the first emitting light quantity (E=0) (within a range of the negative-polarity voltage application), i.e., a maximum transmitted light quantity (in the case of E<0) when the liquid crystal molecules are placed in a prescribed tilt state under application of a prescribed (negative-polarity) voltage (having an absolute value identical to that of the positive voltage providing the second emitting light quantity).

However, a difference in maximum transmitted light quantity between the negative-polarity voltage application (E<0, FIG. 6AA) and no voltage application (E=0, FIG. 6BA) is smaller than a difference in maximum transmitted light quantity between the positive-polarity voltage application (E>0, FIG. 6CA) and no voltage application (E=0, FIG. 6BA), thus attaining a maximum transmitting light quantity of the liquid crystal device used in the present invention under the positive-polarity voltage application.

Figure 6D:
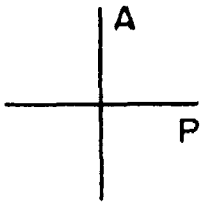

In the case where a pair of polarizers having polarizing axes A and P as shown in FIG. 6D is used, if a tilting angle (based on the monostabilized molecular position under E=0) of the liquid crystal molecules 14 in the maximum tilt state under E>0 is at most 45 degrees, the liquid crystal molecules 14 located on the virtual cone 15 edge (i.e., in the maximum tilt state) provide the maximum transmitted light quantity under E>0 (i.e., the second emitting light quantity). If the tilting angle of the liquid crystal molecules 14 is above 45 degrees, the liquid crystal molecules 14 located inside the virtual cone edge provide the maximum transmitted light quantity under E>0 (the second emitting light quantity). On the other hand, in the case of applying the negative-polarity voltage (E<0), the liquid crystal molecules 14 can provide the maximum transmitted light quantity under E<0 (i.e., the third emitting light quantity) in the maximum tilt state irrespective of the tilting angle thereof (based on the molecular position under E=0).

The liquid crystal device using the liquid crystal material exhibiting the above-described switching (inversion) behavior of liquid crystal molecules may, e.g., exhibit a voltage-transmittance (V-T) characteristic, particularly in the case where liquid crystal molecules are placed in a maximum (largest) tilt state under positive-polarity voltage application, as shown in FIG. 7.

Referring to FIG. 7, when a voltage (V) of a positive-polarity is applied, a resultant transmittance (T) is continuously increased with a magnitude (absolute value) of the applied (positive-polarity) voltage (V) due to tilting of the liquid crystal molecules and shows a maximum transmittance T1 under application of a voltage V1 or above. On the other hand, a negative-polarity voltage is applied, the transmittance (T) is somewhat continuously increased with an increasing magnitude of the applied (negative-polarity) voltage (V) but is saturated at T2, which is considerably lower than T1, under application of a voltage −V1 or above (as an absolute value).

In the present invention, when the above-mentioned liquid crystal device allowing the switching behavior as shown in FIGS. 6AA to 6D and exhibiting the V-T characteristic as shown in FIG. 7 is used as an ordinary liquid crystal panel of an active matrix type (equipped with TFTs) functioning as an optical shutter and is supplied with an AC (alternating current) driving waveform including a combination of one (positive)-polarity voltage application period (allowing the optical response on the positive-polarity side shown in FIG. 7) and the other (negative)-polarity voltage application period (allowing the optical response on the negative-polarity side shown in FIG. 7), it is possible to attain an effect similar to that obtained in the above-described motion picture display scheme utilizing a time aperture rate of at most 50%. Thus, it becomes possible to provide (liquid crystal) display apparatus including the liquid crystal device improved in motion picture image qualities without using complicated peripheral circuits etc.

In this case, in order to further enhance the motion picture image qualities, it is preferred that a ratio of a tilting angle of liquid crystal molecules (average molecular axis) in a maximum tilt state (i.e., maximum tilting angle) under application of a voltage of a first polarity (positive polarity in the case of FIG. 6CA) to a maximum tilting angle under application of a voltage of a second polarity (negative polarity in the case of FIG. 6AA) is set to be at least 5. It is also preferred that a ratio of a maximum emitting light quantity (e.g., the transmittance T1 in FIG. 7) of liquid crystal molecules in a prescribed tilt state under the first (positive-)polarity voltage application to a maximum emitting light quantity (e.g., the transmittance T2 in FIG. 7) of liquid crystal molecules in a maximum tilt state under the second (negative-)polarity voltage application is set to be at least 5.

Hereinbelow, an inversion (switching) mechanism of liquid crystal molecules placed in some alignment states of a liquid crystal material used in the liquid crystal device according to the present invention by contrast with the SSFLC device.

When liquid crystal molecules of the SSFLC are placed in the C1 and C2 alignment states shown in FIGS. 1A, 1B, 2A and 2C, the liquid crystal molecules are required to cross or overcome an energy barrier of a certain potential level in order to effect switching between bistable states thereof in each of the C1 and C2 alignment states. The presence of the energy barrier is the origin of bistability of a chiral smectic liquid crystal.

On the other hand, in the liquid crystal device used in the present invention, when liquid crystal molecules are, e.g., placed in an alignment state as shown in FIG. 5, the liquid crystal molecules 14 are extremely stabilized at a position closer to a position at one of bistable potentials of the SSFLC, thus resulting in only one stable state. As a result in the present invention, an analog-like stable state is present depending on a magnitude of an applied voltage, and the applied provide one-to-one (corresponding) relationship, thus realizing inversion switching in a continuous manner without forming a domain (domain wall).

Examples of the energy barrier (potential level) are shown in FIGS. 8A, 8B, 9A and 9B.

Figure 8A:
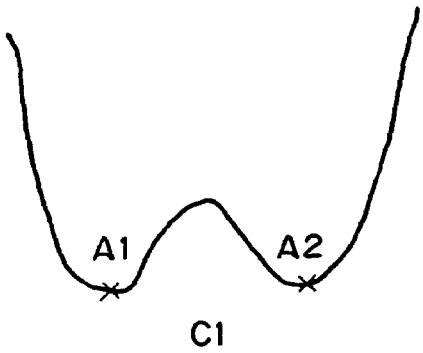
FIGS. 8A and 8B are illustrations of states of energy potentials of an SSFLC in C1 alignment and C2 alignment, respectively.
Figure 8B:
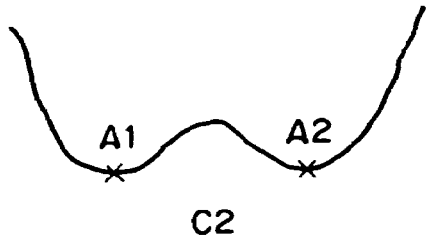

FIGS. 8A and 8B show potential curves of the SSFLC in C1 alignment and C2 alignment, respectively.

Referring to FIGS. 8A and 8B, A1 represents a potential in one stable state and A2 represents a potential in the other stable state.

As apparent from these figures, the SSFLC exhibits a potential state somewhat different in (potential) level between C1 alignment and C2 alignment.

In the case of C1 alignment of the SSFLC, an angle formed between average molecular axes in bistable states is larger than that in the case of C2 alignment (of the SSFLC) (FIGS. 2A and 2B), thus resulting in a higher energy barrier.

Figure 9A:
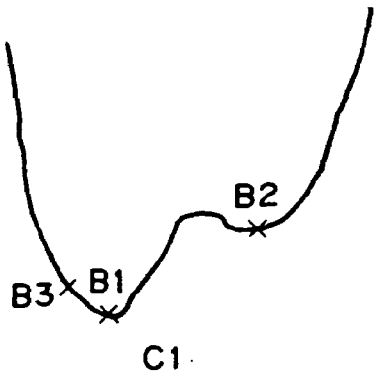
FIGS. 9A and 9B are illustrations of states of energy potentials of a liquid crystal materials in a liquid crystal device used in the present invention in C1 alignment and C2 alignment, respectively.
Figure 9B:
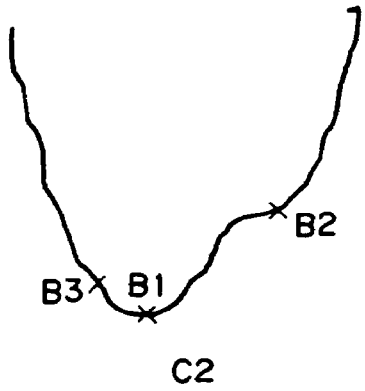

On the other hand, FIGS. 9A and 9B show potential curves of a liquid crystal material in C1 alignment and C2 alignment, respectively, used in the liquid crystal device constituting the (liquid crystal) display apparatus of the present invention.

Referring to FIGS. 9A and 9B, B1 represents a potential under no voltage application (in the case of E=0 shown in FIGS. 6BA an 6BB), B2 represents a potential (of liquid crystal molecules in a maximum tilt state) under positive-polarity voltage application (in the case of E>0 shown in FIGS. 6CA and 6CB), and B3 represents a potential (of liquid crystal molecules in a maximum tilt state) under negative-polarity voltage application (in the case of E<0 shown in FIGS. 6AA and 6AB).

As shown in these figures, the potential curves in C1 alignment and C2 alignment are quite different from those of the SSFLC, respectively, thus resulting in a different driving characteristic.

Particularly, in C1 alignment providing higher energy barrier, as shown in FIG. 9A, even when the liquid crystal molecules are extremely stabilized at a position at the potential B1, a position at the potential B2 can provide the liquid crystal molecules with a stable state or metastable state (wherein the potential B2 is relatively higher but is stable when compared with other positions). As a result, when the voltage application for optical response of the liquid crystal molecules in C1 alignment is performed, as analog-like stable state depending on a magnitude of the applied voltage is present and the applied voltage and the resultant stable molecular position provide one-to-one relationship, thus realizing a continuous inversion switching with no domain wall formation. However, in some cases, a discontinuous alignment state is formed, i.e., a discontinuous inversion behavior with domain wall formation is effected, when the potential exceeds a certain level.

On the other hand, in C2 alignment as shown in FIG. 9B, the energy barrier in the case of the SSFLC is lower. Accordingly, even when a position at the potential B1 is extremely stabilized, it is possible to realize a continuous inversion switching with no domain wall formation to a position at the potential B2.

As is also understood from FIGS. 9A and 9B, a driving voltage is liable to become higher in the case of C1 alignment.

As described above, with respect to an alignment state of liquid crystal molecules in the present invention, C2 alignment-may preferably be adopted in a parallel rubbing cell in view of an analog-like gradational display performance and a lower driving voltage. Further, in the case where the alignment state of liquid crystal molecules is one wherein C1 alignment and C2 alignment are co-present, a lower pretilt angle and/or an anti-parallel rubbing may desirably be adopted in order to minimize fluctuations in analog-like gradational display performance and driving voltage.

In the display apparatus of the present invention, the above-described liquid crystal device exhibiting the inversion switching behavior such that the liquid crystal molecules 14 are (mono-)stabilized inside one of the edges of the virtual cone 15 under no voltage application to lose a memory characteristic (bistability) in SmC* and are switched depending on the applied voltage value as shown in FIGS. 6AA, 6AB, 6BA, 6BB, 6CA, 6CC, 9A and 9B and the V-T (optical response) characteristic as shown in FIG. 7 may, e.g., be prepared by using an appropriate liquid crystal material, controlling appropriately a cell design and effecting such a treatment that an internal potential within a cell in the course f the phase transition from Ch to SmC* is localized In the present invention, as the liquid crystal material, a chiral smectic liquid crystal material (or composition) may preferably be used.

Examples of the chiral smectic liquid crystal material may include those of hydrocarbon-type containing a phenyl-pyrimidine skeleton, a biphenyl skeleton and/or a phenyl-cyclohexane ester skeleton. In the case where these materials have a layer spacing (d)-changing characteristic in a chiral smectic phase temperature range such that a layer spacing ($d_{tc}$) at the upper limit temperature of the chiral smectic phase is a maximum value ($d<d_{tc}$) and a chevron (layer) structure within a cell, these materials may appropriately be blended to prepare a chiral smectic liquid crystal composition providing a layer inclination angle δ (degrees) satisfying: 3 (deg.)<δ<Ⓗ (δ: an inclination angle of smectic layer from a normal to substrate within the cell; Ⓗ: the above-mentioned cone angle which is half of the apex angle of the virtual cone).

It is also possible to use at least one species of liquid crystal materials of hydrocarbon-type containing a naphthalene skeleton or fluorine-containing liquid crystal materials. These materials may generally exhibit a substantially certain layer spacing (d) within a chiral smectic phase temperature range and δ≦3 (deg.) within a cell. In this instance, these material may preferably be blended so as to prepare a chiral smectic liquid crystal composition exhibiting a cone angle Ⓗ-changing characteristic such that a cone angle Ⓗ at a temperature immediately below the phase transition temperature from a higher-order phase to chiral smectic phase is gradually increased on temperature decrease within the chiral smectic phase temperature range.

In the present invention, a cone angle Ⓗ of the liquid crystal material in chiral smectic phase may ideally be at least 22.5 deg. in order to further enhance a contrast between two states providing maximum and minimum light quantities based on switching of liquid crystal materials (e.g., in order to further increase the maximum transmittance T1 (E>0) in the V-T characteristic shown in FIG. 7). On the other hand, when the cone angle Ⓗ is very large, a tilting angle from the monostabilized state under the other polarity-voltage application (i.e., a tilting angle toward the alignment state shown in FIG. 6AA (E<0)) also becomes larger. As a result, e.g., the maximum transmittance T2 (E<0) in the V-T characteristic shown in FIG. 7 becomes larger, thus being liable to provide a time aperture rate of 100%. In view of this phenomenon, the cone angle may preferably be below 30 deg. Further, if the cone angle Ⓗ is larger changed with temperature, a darkest state within a cell provided with a pair of cross-nicol polarizers is liable not to be maintained. For this reason, the cone angle Ⓗ may preferably be controlled so that its value within a driving temperature range for the liquid crystal device is fluctuated within ±3 deg.

In the case where the liquid crystal material has a layer spacing-changing characteristic such that a layer spacing is decreased by tilting of liquid crystal molecules from a (smectic) layer normal direction similarly as in an ordinary liquid crystal material assuming SmC* (i.e., in the case of a liquid crystal material providing an increasing cone angle Ⓗ on temperature decrease), a factor of decreasing the layer spacing becomes larger. However, when the liquid crystal material used is, e.g., a fluorine-containing liquid crystal material which per se spontaneously exhibiting a bookshelf (layer) structure, the change in layer spacing can be made very small based on a property intrinsic to the fluorine-containing liquid crystal material such that the layer spacing measured in a bulk state becomes larger on temperature decrease. This may be considered to be the reason why the fluorine-containing liquid crystal material is not readily formed. In this instance, liquid crystal molecules at a boundary with a substrate are aligned with a rubbing (uniaxial aligning treatment) direction due to a uniaxial aligning control force and bulk liquid crystal molecules are oriented in a direction deviated from the rubbing direction depending on the temperature characteristic of the cone angle Ⓗ in some cases. At that time, if an electric field is applied to the liquid crystal material, the boundary liquid crystal molecules are also oriented in a direction deviated from the rubbing direction similarly as in the bulk liquid crystal molecules.

Incidentally, in order to provide an internal potential localization within the liquid crystal device for preferentially forming one of two (smectic) layer structures as shown in FIG. 5, i.e., for making constant a deviation direction of a smectic layer normal from an average uniaxial aligning treatment axis, for example, the following methods (1)-(4) may be adopted.

(1) During a phase transition from Ch to SmC* or from Iso. to SmC*, a DC (direct current) voltage of a positive or negative polarity is applied between a pair of substrates.

(2) A pair of substrates is provided with alignment films different in material, respectively.

(3) A pair of substrates each provided with an alignment film is subjected to different treating methods in terms of, e.g., film-forming conditions, rubbing strength, and UV irradiation conditions.

(4) A pair of substrates each provided with an alignment film is further provided with a layer underlying the alignment film and the underlying layer is changed in material or thickness for each substrate.

In the above method (1), in order to avoid an occurrence of short circuit between the pair of substrates constituting the liquid crystal device due to a DC voltage application for a long period of time, the DC voltage application time may preferably be as short as possible if it is sufficient to provide a uniform layer formation direction. Specifically, the applied DC voltage may preferably be 100 mV to 10 V.

Ions (impurities) within the above-mentioned liquid crystal materials and the alignment films as used in the above methods (2), (3) and (4) may desirably be as little as possible so as not to adversely affect TFT-driving scheme.

In order to monostabilize liquid crystal molecules (average molecular axis) under no voltage application within the liquid crystal device used in the present invention, a uniaxial aligning control force is required to be large.

With respect to this aligning control force, an evaluation method using a cholesteric liquid crystal has been proposed by Uchida et al. ("Liquid Crystals", vol. 5, p. 1127 (1989)). More specifically, according to this method, it is possible to evaluate the aligning control force by determining an "effective twisting angle" based on a torque balance between a helical pitch in cholesteric phase and the aligning control force.

In the present invention, based on this method, the uniaxial aligning control force may be evaluated as follow.

In the case where the liquid crystal material used in the liquid crystal device has cholesteric phase, when there is no aligning control force, the following relationship is fulfilled:

$$dg/p=\phi/2\pi,$$

wherein dg represents a cell thickness, p represents a cholesteric (helical) pitch and $\phi$ represents a twisting angle within a cell.

On the other hand, in the case where a pair of substrates is subjected to uniaxial aligning treatment so that their uniaxial aligning treatment axes are parallel to each other to provide an infinite (extremely larger) aligning control force, the resultant twisting angle $\phi$ becomes zero. The twisting angle $\phi$ may be readily determined by measuring optical rotation through a polarizing microscope similarly as in the above Uchida et al., method. More specifically, with the cell, the cholesteric liquid crystal has a virtual helical pitch $p^*$ ($=2\pi\times dg/\phi$) larger than the original helical pitch p due to the aligning control force. In other words, the aligning control force may be defined as zero when $p^*=p$ and infinite when $p^*$ is infinite.

In the present invention, it is preferred to at least satisfy $p^*\geqq 2\times p$, more preferably $p^*\geqq 10\times p$ in order to ensure the monostabilization.

In view of the above circumferences, in the present invention, it is preferred to appropriately set uniaxial aligning treatment (e.g., rubbing) conditions, aligning film thickness, alignment film material, curing conditions for the aligning film, etc. according to the above-mentioned methods (2)-(4).

In the present invention, when a V-T characteristic is determined under application of a triangular wave, a hysteresis phenomenon is observed in some cases.

However, when the liquid crystal device is driven by applying an AC waveform as in an actual TFT-type liquid crystal device, the hysteresis phenomenon is of substantially no problem since a continuous optical modulation form a white state to a halftone state as in the case of the triangular wave application is not effected. More specifically, in the case of the AC waveform application, an optical modulation is performed while always effecting inversion between white and black (alignment) states depending on a polarity of an applied voltage. For example, when an optical modulation from a white state to a halftone state, the white to halftone optical modulation is performed from the white state to the halftone state via, the white to halftone optical modulation is performed from the white state to the halftone state via a black state, so that the AC waveform application allows such a driving operation that a display state is written after always resetting in a black state on the side of one of two polarities. As a result, an adverse affect of a previous state (display history) can be considerably suppressed.

Hereinbelow, an embodiment of the liquid crystal device used in the present invention will be described with reference to FIG. 10.

Figure 10:
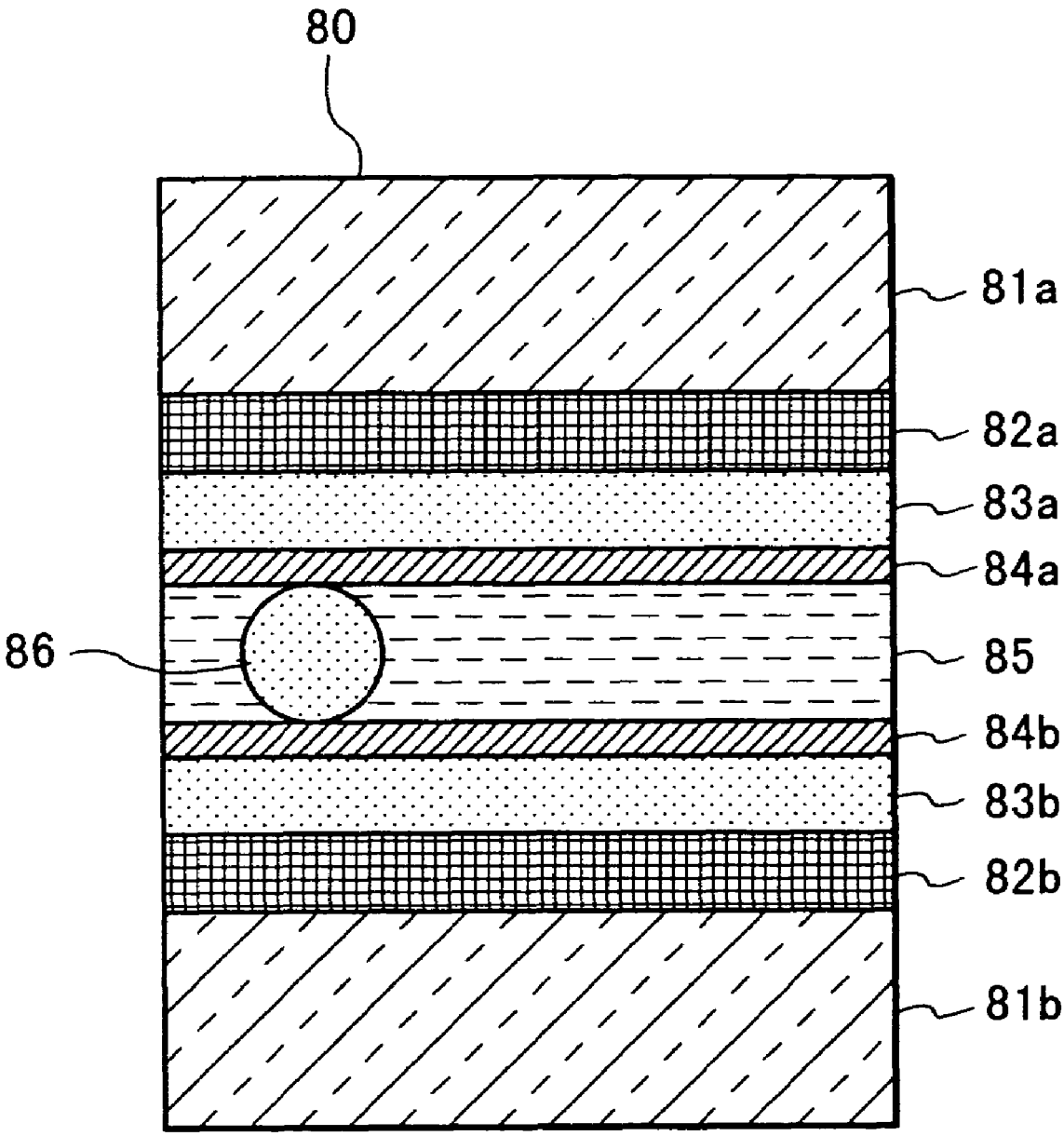
FIG. 10 is a schematic sectional view of an embodiment of a liquid crystal device used in the present invention.

FIG. 10 shows a schematic sectional view of a liquid crystal device 80 constituting a (liquid crystal) display apparatus according to the present invention.

The liquid crystal device 80 includes a pair of substrates 81*a* and 81*b*; electrodes 82*a* and 82*b* disposed on the substrates 81*a* and 81*b*, respectively; insulating films 83*a* and 83*b* disposed on the electrodes 82*a* and 82*b*, respectively; alignment control films 84*a* and 84*b* disposed on the insulating films 83*a* and 83*b*, respectively; a liquid crystal 85 disposed between the alignment control films 84*a* and 84*b*; a spacer 86 disposed together with the liquid crystal 85 between the alignment control films 84*a* and 84*b*; and a pair of polarizers (not shown) sandwiching the pair of substrates

81*a* and 81*b* with polarizing axes arranged perpendicular to each other (cross-nicol relationship).

The liquid crystal 85 may preferably assume chiral smectic phase.

Each of the substrates 81*a* and 81*b* comprises a transparent material, such as glass or plastics, and is coated with, e.g., a plurality of stripe electrodes 82*a* (82*b*) of $In_2O_3$ or ITO (indium tin oxide) for applying a voltage to the liquid crystal 85. These electrodes 82*b* and 82*b* intersect each other to form a matrix electrode structure, thus providing a simple matrix-type liquid crystal device. As a modification of the electrode structure, one of the substrates 81*a* and 81*b* may be provided with a matrix electrode structure wherein dot-shaped transparent electrodes are disposed in a matrix form and each of the transparent electrodes is connected to a switching element, such as a TFT (thin film transistor) or MIM (metal-insulator-metal), and the other substrate may be provided with a counter (common) electrode on its entire surface or in an prescribed pattern, thus constituting an active matrix-type liquid crystal device.

On the electrodes 82*a* and 82*b*, the insulating films 83*a* and 83*b*, e.g., of $SiO_2$, $TiO_2$ or $Ta_2O_5$ having a function of preventing an occurrence of short circuit may be disposed, respectively, as desired.

On the insulating films 83*a* and 83*b*, the alignment control films 84*a* and 84*b* are disposed so as to control the alignment state of the liquid crystal 85 contacting the alignment control films 84*a* and 84*b*. At least one of (preferably both of) the alignment control films 84*a* and 84*b* is subjected to a uniaxial aligning treatment (e.g., rubbing). Such an alignment control film 84*a* (84*b*) may be prepared by forming a film Of an organic material (such as polyimide, polyimideamide, polyamide or polyvinyl alcohol through wet coating with a solvent, followed by drying and rubbing in a prescribed direction or by forming a deposited film of an inorganic material through an oblique vapor deposition such that an oxide (e.g., SiO) or a nitride is vapor-deposited onto a substrate in an oblique direction with a prescribed angle to the substrate.

The alignment control films 84*a* and 84*b* may appropriately be controlled to provide liquid crystal molecules of the liquid crystal 85 with a prescribed pretilt angle $\alpha$ (an angle formed between the liquid crystal molecule and the alignment control film surface at the boundaries with the alignment control films) by changing the material and treating conditions (of the uniaxial aligning treatment).

In the case where both of the alignment control films 84*a* and 84*b* are subjected to the uniaxial aligning treatment (rubbing), the respective uniaxial aligning treatment (rubbing) directions may appropriately be set in a parallel relationship, an anti-parallel relationship or a crossed relationship providing a crossing angle of at most 45 degrees, depending on the liquid crystal material used.

The substrates 81*a* and 81*b* are disposed opposite to each other via the spacer 86 comprising e.g., silica beads for determining a distance (i.e., cell gap) therebetween, preferably in the range of 0.3-10 μm, in order to provide a uniform uniaxial aligning performance and such an alignment state that an average molecular axis of the liquid crystal molecules under no electric field application is substantially aligned with an average uniaxial aligning treatment axis (a bisector of two uniaxial aligning treatment axes) although the cell gap varies its optimum range and its upper limit depending on the liquid crystal material used.

In addition to the spacer 86, it is also possible to disperse adhesive particles of a resin (e.g., epoxy resin) (not shown) between the substrates 81*a* and 81*b* in order to improve adhesiveness therebetween and an impact (shock) resistance of the liquid crystal having chiral smectic C phase (SmC*).

A liquid crystal device 80 having the above cell structure and a specific alignment state as shown in FIGS. 6AA to 6CB can be prepared by using a liquid crystal material 85 exhibiting a chiral smectic phase, while adjusting the composition thereof, and further by appropriate adjustment of the liquid crystal material treatment, the device structure including a material, and a treatment condition for alignment control films 84*a* and 84*b*. More specifically, the alignment state of FIGS. 6AA to 6CB is realized by a liquid crystal device wherein the liquid crystal molecules are aligned to provide an average molecular axis to be mono-stabilized in the absence of an electric field applied thereto and, under application of voltages of one polarity (a first polarity), are realigned to provide a tilting angle which varies continuously from the average molecular axis of the monostabilized position depending on the magnitude of the applied voltage. On the other hand, under application of voltages of the other polarity (i.e., a second polarity opposite to the first polarity), the liquid crystal molecules are tilted from the average molecular axis under no electric field depending on the magnitude of the applied voltages, but the maximum tilting angle obtained under application of the second polarity voltages is substantially smaller than the maximum tilting angle formed under application of the first polarity voltages. The liquid crystal material showing a chiral smectic phase may preferably exhibit a phase transition series on temperature decrease of Iso. (isotropic phase)-Ch (cholesteric phase)-SmC* (chiral smectic C phase) or Iso. phase-SmC* and be placed in a non-memory state in the SmC* by using the above-mentioned methods (1)-(4).

The liquid crystal material 85 showing chiral smectic phase may preferably have a helical pitch which is at least twice a cell gap in a bulk state thereof.

The liquid crystal material 85 showing chiral smectic phase may preferably be a composition prepared by appropriately blending a plurality of liquid crystal materials exhibiting, e.g., the above-described characteristics (in terms of a cone angle Ⓗ, a (smectic) layer spacing d and a layer inclination angle δ) selected from hydrocarbon-type liquid crystal materials containing a biphenyl, phenyl-cyclohexane ester or phenyl-pyrimidine skeleton, naphthalene-type liquid crystal materials and fluorine-containing liquid crystal materials.

When the liquid crystal device 80 as described above has such a cell structure that at least one of the substrates 81*a* and 81*b* is provided with a polarizer and the cell is disposed to provide a darkest state under no voltage application, a tilting angle of liquid crystal molecules (of the liquid crystal material 85) varies continuously under voltage application as described above to provide a V-T characteristic as shown in FIG. 7. As a result, a resultant transmitted light quantity of the device (emitting light quantity from the device) can be controlled in an analog-like manner with a change in applied voltage.

The liquid crystal device used in the present invention may be formed in a color liquid crystal device by providing one of the substrates 81*a* and 81*b* with a color filter comprising color filter segments of at least red (R), green (G) and blue (B).

In the present invention, the liquid crystal device may be applicable to various liquid crystal devices including: a liquid crystal device of a transmission-type herein a pair of transparent substrates 81*a* and 81*b* is sandwiched between a pair of polarizers to optically modulate incident light (e.g., from an eternal light source) through one of the substrate 81*a* and 81*b* to be passed through the other substrate, and a liquid crystal device of a reflection-type wherein at least one of a pair of substrates 81*a* and 81*b* is provided with a polarizer to optically modulate incident light and reflected light and pass the light through the substrate on the light incident side. The reflection-type liquid crystal device may, e.g., be prepared by providing a reflection plate to either one of the substrates 81*a* and 81*b* or forming of a reflective material one of the substrates or a reflecting member provided thereto.

In the present invention, by using the above-mentioned liquid crystal device in combination with a drive circuit for supplying gradation signals to the liquid crystal device, it is possible to provide a liquid crystal display apparatus capable of effecting a gradational display based on the above-mentioned alignment and V-T characteristics such that under voltage application, a resultant tilting angle varies continuously from the monostabilized position of the average molecular axis (of liquid crystal molecules) and a corresponding emitting light quantity continuously changes.

For example, it is possible to use, as one of the pair of substrates, an active matrix substrate provided with a plurality of switching elements (e.g., TFT (thin film transistor) or MIM (metal-insulator-metal)) in combination with a drive circuit (drive means), thus effecting an active matrix drive based on amplitude modulation to allow a gradational display in an analog-like gradation manner.

Hereinbelow, an embodiment of a liquid crystal display apparatus of the present invention including a liquid crystal device provided with such an active matrix substrate will be explained with reference to FIGS. 11-13.

FIG. 11 shows a schematic plan view of such a display apparatus including a liquid crystal device and a drive circuit (means) and principally illustrates a structure on the active matrix substrate side.

Referring to FIG. 11, a liquid crystal device (panel) 90 includes a structure such that gate lines (G1, G2, G3, G4, G5, . . . ) corresponding to scanning lines connected to a scanning signal driver 91 (drive means) and source lines (S1, S2, S3, S4, S5, . . . ) corresponding to data signal lines connected to a data signal driver 92 (drive means) are disposed to intersect each other at right angles in an electrically isolated state, thus forming a plurality of pixels (5×5 in FIG. 11) each at intersection thereof. Each pixel is provided with a thin film transistor (TFT) 94 as a switching element and a pixel electrode 95 (as an effective drive region). The switching element may be a metal-insulator-metal (MIM) element. The gate lines (G1, G2, . . . ) are connected with gate electrodes (not shown) of the TFT 94, respectively, and the source lines (S1, S2, . . . ) are connected with source electrodes (not shown) of the TFT 94, respectively. The pixel electrodes 95 are connected with drain electrodes (not shown) of the TFT 94, respectively.

A gate voltage is supplied to the gate lines (G1, G2, . . . ) from the scanning signal driver 91 by effecting scanning selection in, e.g., a line-sequential manner. In synchronism with this scanning selection on the gate lines, the source lines (S1, S2, . . . ) are supplied with a data signal voltage depending on writing data for each pixel from the data signal driver 92. The thus-supplied gate and data signal voltages are applied to each pixel electrode 95 via the TFT 94.

FIG. 12 shows a sectional structure of each pixel portion (corr. to 1 bit) in the panel structure shown in FIG. 11.

Referring to FIG. 12, a layer of a liquid crystal material 49 having a spontaneous polarization are sandwiched between an active matrix substrate or plate 20 provided with a TFT 94 and a pixel electrode 95 and an opposing substrate or plate 40 provided with a common electrode 42, thus providing a liquid crystal capacitor (C1*c*) 31 of the liquid crystal layer 49.

In this embodiment, the active matrix substrate 20 includes an amorphous silicon (a-Si) TFT as the TFT 94. The TFT may be of a poly crystalline-Si type, i.e., (p-Si) TFT.

The TFT 94 is formed on a substrate 21 of, e.g., glass and includes: a gate electrode 22 connected with the gate lines (G1, G2, . . . shown in FIG. 11); an insulating film (gate insulating film) 23 of, e.g., silicon nitride (SiNx) formed on the gate electrode 22; an a-Si layer 24 formed on the insulating film 23; $n^+$ a-Si layers 25 and 26 formed on the a-Si layer 24 and spaced apart from each other; a source electrode 27 formed on the $n^+$ a-Si layer 25; a drain electrode 28 formed on the $n^+$ a-Si layer 26 and spaced apart from the source electrode 27; a channel protective film 29 partially covering the a-Si layer 24 and the source and drain electrodes 27 and 28. The source electrode 27 is connected with the source lines (S1, S2, . . . shown in FIG. 11) and the drain electrode 28 is connected with the pixel electrode 95 (FIG. 11) of a transparent conductor film (e.g., ITO film). The TFT 94 is placed in an "ON" state by applying a gate pulse to the gate electrode 22 during a scanning selection period of the corresponding gate line.

Further, on the active matrix substrate 20, a structure constituting a holding or supplementary capacitor (Cs) 32 is formed by the pixel electrode 95, a holding capacitor electrode 30 disposed on the substrate 21, and a portion of the insulating film 23 sandwiched therebetween. The structure (holding capacitor) (Cs) 32 is disposed in parallel with the liquid crystal capacitor (C1*c*) 31. In the case where the holding capacitor electrode 30 has a large area, a resultant aperture or opening rate is decreased. In such a case, the holding capacitor electrode 30 is formed of a transparent conductor film (e.g., ITO film).

On the TFT 94 and the pixel electrode 95 of the active matrix substrate 20, an alignment film 43*a* for controlling an alignment state of the liquid crystal 49. The alignment film 43*a* is subjected to a uniaxial aligning treatment (e.g., rubbing).

On the other hand, the opposing substrate 40 includes a substrate (e.g., glass substrate) 41; a common electrode 42 having a uniform thickness disposed on the entire substrate 41; and an alignment film 43*b* having a uniform thickness, disposed on the common electrode 42, for controlling an alignment state of the liquid crystal 49.

The above panel (cell) structure (liquid crystal device) including a plurality of the pixels each having the structure shown in FIG. 12 is sandwiched between a pair of polarizers (not shown) with polarizing axes intersecting each other at right angles.

The liquid crystal material constituting the liquid crystal layer 49 may preferably be a chiral smectic liquid crystal (composition) which has a spontaneous polarization and exhibits the above-mentioned alignment state (or switching behavior) shown in FIGS. 6AA-6D and V-T (optical response) characteristic shown in FIG. 7.

Next, an example of an ordinary active matrix driving method according to the present invention utilizing the liquid crystal device using the active matrix substrate (plate) and a chiral smectic liquid crystal having the characteristics as described above will be described with reference to FIGS. 13 and 14 in combination with FIGS. 11 and 12.

Figure 13:
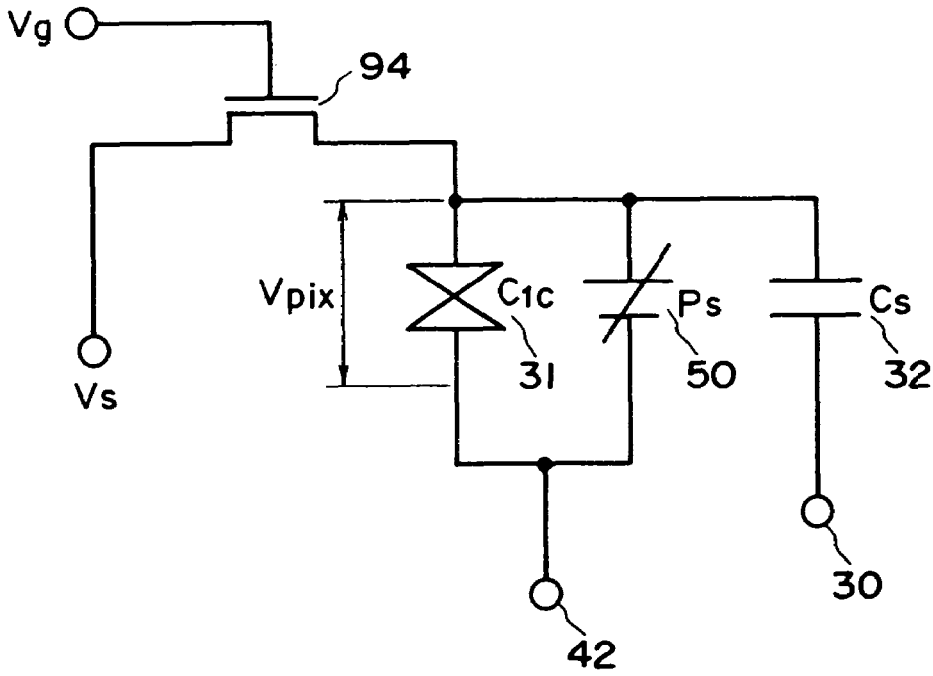
FIG. 13 shows an equivalent circuit of each pixel portion shown in FIG. 12.

FIG. 13 shows an example of an equivalent circuit for each pixel portion of such a liquid crystal device shown in FIG. 12.

Figure 14:
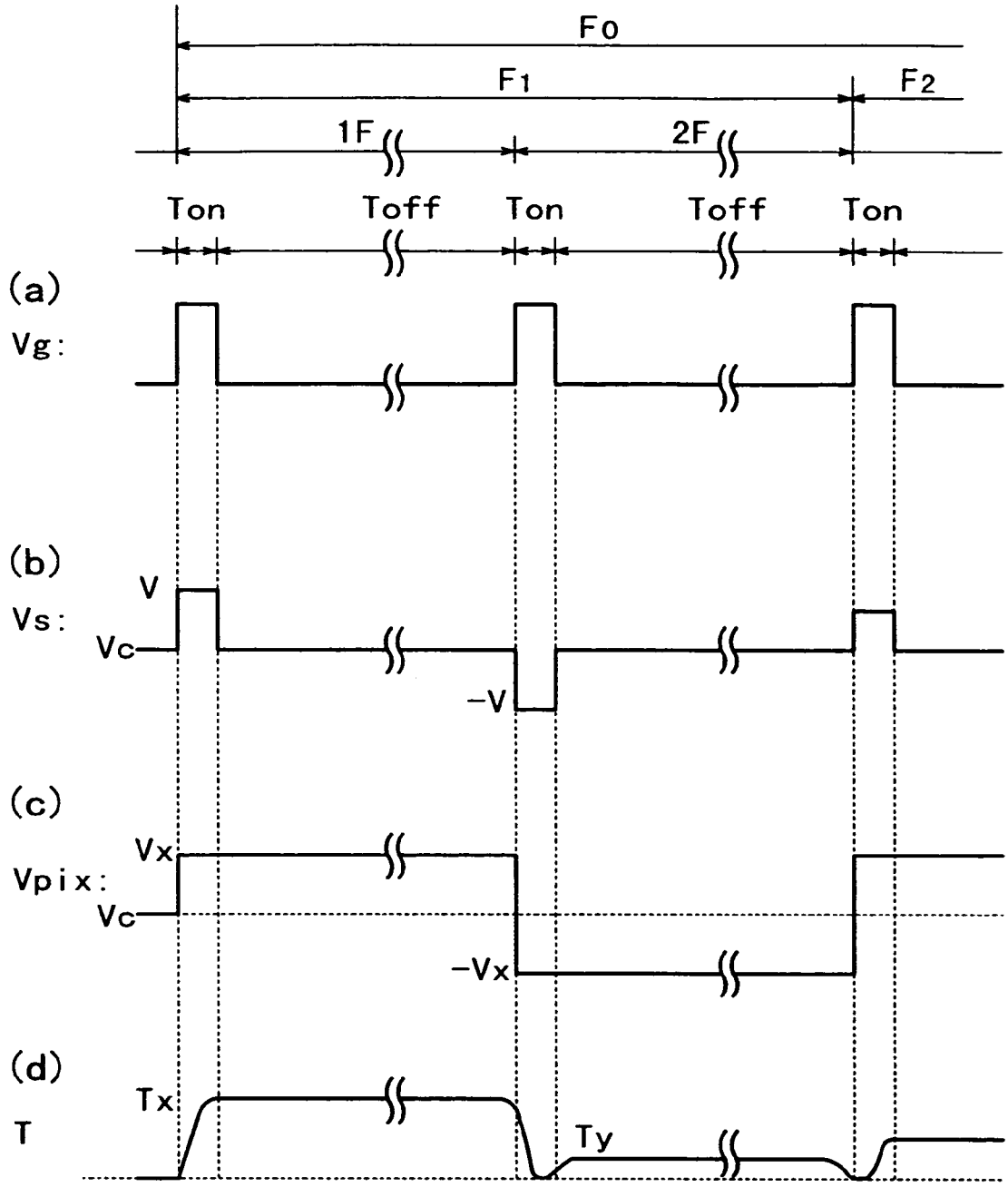
FIG. 14 shows drive waveform diagrams (at (a), (b) and (c)) for driving the active matrix-type liquid crystal device shown in FIG. 11 and a corresponding transmitted light quantity (at (d)).

In the active matrix driving method according to the present invention described below, the liquid crystal material used for the liquid crystal layer 49 comprises a chiral smectic liquid crystal (composition) providing a V-T characteristic as shown in FIG. 7 and, as shown in FIG. 14, one frame period F0 for displaying a prescribed information (e.g., a full-color image) is divided into a plurality of field periods F1, F2, . . . , each for a prescribed image (e.g., any one of color images of R, G and B), and each of the field periods (e.g., the field period F1) is further divided into a plurality of sub-field periods (1F and 2F in this embodiment).

In each of the sub-field periods 1F and 2F, a prescribed emitting liquid quantity depending on a prescribed image information for each sub-field period is obtained. Further, in each field period (e.g., F1), an average of the emitting light quantities in the sub-field periods 1F and 2F is obtained to provide a prescribed image (e.g., red image). As a result, in one frame period F0, a desired display information (e.g., a full-color image) can be provided based on plural images displayed in the plurality of field periods F1, F2, . . . .

FIG. 14 shows at (a) a voltage waveform applied to one gate line (e.g., G1 shown in FIG. 11) (as a scanning line) connected with each pixel.

Figure 20:
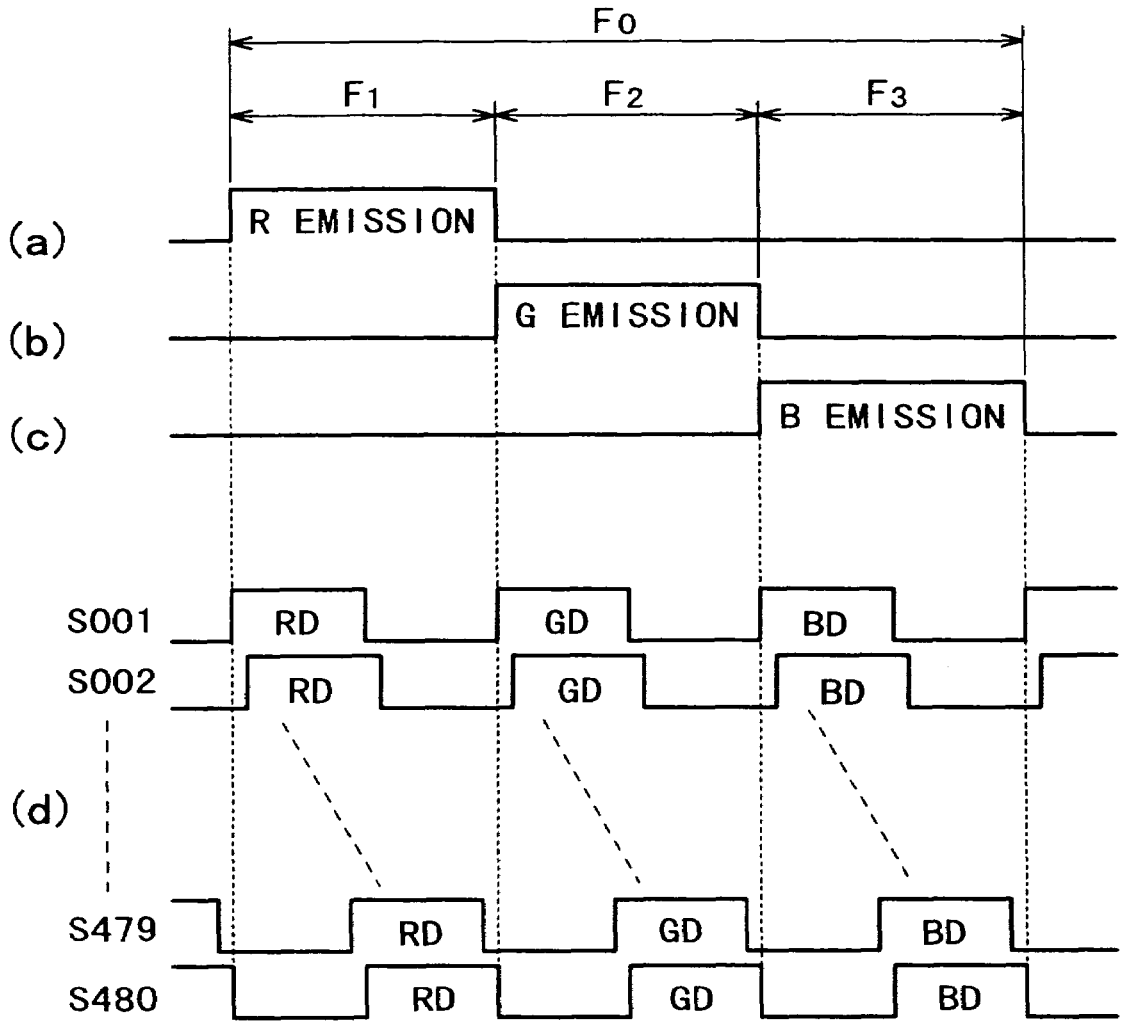
FIG. 20 is a time chart for illustrating an embodiment of a conventional driving method for a liquid crystal apparatus.

In the liquid crystal device driven by the active matrix driving method, the gate lines G1, G2, . . . shown in FIG. 20 are selected in a line-sequential manner in each of the sub-field periods 1F and 2F. At this time, each gate electrode 22 connected with a corresponding gate line is supplied with a prescribed gate voltage Vg in a selection period $T_{on}$ of each sub-field period (e.g., 1F), thus placing the TFT 94 in an "ON" state. In a non-selection period Toff (of, e.g., the sub-field period 1F) corresponding to a period in which other gate lines are selected, the gate electrode 22 is not supplied with the gate voltage Vg, thus placing the TFT 94 in an "OFF" state (high-resistance state). In every non-selection period $T_{off}$, a prescribed and same gate line is selected and a corresponding gate electrode 22 is supplied with the gate voltage Vg.

FIG. 14 shows at (b) a voltage waveform applied to one source line (e.g., S1 shown in FIG. 11) (as a data signal line) connected to the pixel concerned.

When the gate electrode 22 is supplied with the gate voltage Vg in the selection period $T_{on}$ of each sub-field period 1F or 2F as shown at (a) of FIG. 14, in synchronism with this voltage application, a prescribed source voltage (data signal voltage) Vs having a prescribed potential providing a writing data (pulse) to the pixel concerned is applied to a source electrode 27 through the source line connected with the pixel based on a potential Vc of a common electrode 42 as a reference potential.

More specifically, in the first sub-field period 1F constituting the first field period F1, a positive-polarity source voltage Vs having a potential Vx (=V) (based on a reference potential Vc) providing a desired optical state or display data (transmittance) based on the V-T characteristic as shown in FIG. 7 is applied to the source electrode 27 concerned.

At this time, the TFT 94 is in an "ON" state, whereby the positive-polarity source voltage Vx applied to the source electrode 27 is supplied to a pixel electrode 95 via a drain electrode 28, thus charging a liquid crystal capacitor (C1*c*) 31 and a holding capacitor (Cs) 32. As a result, the potential of the pixel electrode 95 becomes a level equal to that of the positive-polarity source (data signal) voltage Vx.

Then, in a subsequent non-selection period Toff, for the gate line on the pixel concerned, the TFT 94 is in an "OFF" (high-resistance) state. At this time (in $T_{off}$ of 1F), in the liquid crystal cell, the liquid crystal capacitor (C1*c*) 31 and the holding capacitor (Cs) 32 retain the electric charges therein, respectively, charged in the selection period $T_{on}$ to keep the (positive-polarity) voltage Vx. As a result, the liquid crystal layer 49 of the pixel concerned is supplied with the voltage Vx through the first field period 1F to provide thereat a desired optical state (transmitted light quantity) by depending on the voltage Vx.

Thereafter, in the second (subsequent) sub-field period 2F constituting the first field period F1, a negative-polarity source voltage Vs (=−Vx) having an identical potential (absolute value) to but a polarity opposite to the source voltage Vs (=Vx) applied in the first sub-field period 1F is applied to the source electrode 27 concerned.

FIG. 14 shows at (c) a waveform of a pixel voltage Vpix actually held by the liquid crystal capacitor (C1*c*) 31 and the holding capacitor (Cs) 32 of the pixel concerned and applied to the liquid crystal layer 49, and FIG. 14 shows at (d) an example of an actual optical response (in the case of a liquid crystal device of a transmission-type) at the pixel concerned.

As shown at (c) of FIG. 14, an applied voltage through two sub-field periods 1F and 2F comprises the positive-polarity voltage Vx in the first sub-field period 1F and the negative-polarity voltage −Vx (having the same amplitude (absolute value) as Vx). In the first sub-field period 1F, as shown at (d) of FIG. 14, a gradational display state is obtained depending on Vx, and in the second sub-field period 2F, depending on −Vx, another gradational display state is obtained. For example, when these voltage Vx and −Vx are set to voltages V1 and −V1, respectively, as shown in FIG. 7, a higher luminance or transmitted light quantity Tx (transmittance T1 in FIG. 7) is obtained in the first sub-field period 1F. On the other hand, in the second sub-field period 2F, a lower luminance or transmitted liquid quantity 1F. On the other hand, in the second sub-field period 2F, a lower luminance or transmitted light quantity Ty (transmittance T2 in FIG. 7) which is closer to zero but a non-zero value.

At this time, the TFT 94 is in an "ON" state, whereby the negative-polarity source voltage −Vx applied to the source electrode 27 is supplied to a pixel electrode 95, thus charging a liquid crystal capacitor (C1*c*) 31 and a holding capacitor (Cs) 32. As a result, the potential of the pixel electrode 95 becomes a level equal to that of the negative-polarity source (data signal) voltage −Vx.

Then, in a subsequent non-selection period Toff, for the gate line on the pixel concerned, the TFT 94 is in an "OFF" (high-resistance) state. At this time (in $T_{off}$ of 2F), in the liquid crystal cell, the liquid crystal capacitor (C1*c*) 31 and the holding capacitor (Cs) 32 retain the electric charges therein, respectively, charged in the selection period $T_{on}$ to keep the (negative-polarity) voltage Vx. As a result, the liquid crystal layer 49 of the pixel concerned is supplied with the voltage Vx through the second field period 2F to provide thereat a desired optical state (transmitted light quantity) by depending on the voltage Vx.

As described above, by using the chiral smectic liquid crystal as the liquid crystal material providing the V-T characteristic as shown in FIG. 7 in the active matrix driving method, it becomes possible to effect a good gradational display based on a high-speed responsiveness of the chiral smectic liquid crystal. In addition, a gradational display of a prescribed level at each pixel is continuously performed by dividing one field pixel (e.g., F1) into a first sub-field pixel 1F providing a higher transmitted light quantity and a second sub-field period 2F providing a lower transmitted light quantity, thus resulting in a time aperture rate of at most 50% to improve a human-sensible high-speed responsiveness with respect to motion picture display. Further, in the second sub-field period 2F providing the lower transmitted light quantity, the resultant transmitted light quantity is not zero due to a slight switching (inversion) performance of liquid crystal molecules, thus ensuring a certain human-sensible luminance through the entire field period (and also through the entire frame period).

In the present invention, the above-described higher luminance display at the transmitted light quantity Tx (performed in the first sub-field period 1F in the above embodiment) may be performed in the second sub-field period 2F and the lower luminances display at the transmitted light quantity Ty (performed in the second sub-field period 2F may be performed in the first sub-field period 1F. Thus, the order of higher and lower luminance displays may appropriately be changed to any order as desired.

In the above embodiment, the polarity of the voltage (Vx or −Vx) is changed alternately for every sub-field period (1F or 2F) (i.e., polarity-inversion for each sub-field period), whereby the voltage actually applied to the liquid crystal layer 49 is continuously changed in an alternating manner to suppress a deterioration of the liquid crystal material used even in a continuous display operation for a long period.

As described above, in the above active matrix driving method, in each field period (e.g., F1) consisting of two sub-field periods 1F and 2F, a resultant transmitted light quantity corresponds to an average of Tx and Ty. Accordingly, in order to obtain a further higher transmitted light quantity in each field period, it is preferred to apply a source (data signal) voltage Vs providing a transmitted light quantity higher than Tx in the first sub-field substrate 1F by a prescribed level based on the V-T characteristic as shown in FIG. 7.

Second Embodiment

FIG. 15 shows an example of a liquid crystal display apparatus 100 of the present invention according to this embodiment.

Referring to FIG. 15, the liquid crystal display apparatus 100 includes a color light source 101 emitting a plurality of color lights and a display device 80 effecting switching of the color lights in synchronism with emission of the respective color lights.

The display device 80 in this embodiment is a liquid crystal device having a cell structure as shown in FIG. 10.

As shown in FIG. 10, the liquid crystal device 80 has such a cell structure that a liquid crystal 85 is disposed between a pair of substrates 81*a* and 81*b* each provided with a plurality of electrodes 82*a* or 82*b* so as to form a plurality of pixels each at an intersection of the electrodes 82*a* and 82*b*.

The liquid crystal device 80 in this embodiment may be of a simple matrix-type (FIG. 10) or active matrix-type (FIGS. 11 and 12) and also may be of a transmission-type or reflection-type, similarly as in the above-mentioned First Embodiment.

The liquid crystal device 80 may be prepared in the same manner as in First Embodiment described above.

The liquid crystal 85 (liquid crystal material) may be one having a spontaneous polarization, e.g., a chiral smectic liquid crystal (composition). The liquid crystal 85 may preferably assume an alignment (or switching) characteristic as shown in FIGS. 6AA-6D and an optical (V-T) characteristic as shown in FIG. 7.

More specifically, the liquid crystal 85 used in the liquid crystal device 80 may preferably have alignment and V-T characteristics such that an average molecular axis of liquid crystal molecules is monostabilized under no voltage application and, under application of voltages of one polarity is tilted from the monostabilized position in one direction and, under application position in one direction and, under application of voltages of the other polarity (opposite to the above one polarity), is tilted from the monostabilized position in the other direction (opposite to the above one direction).

When the voltages of one polarity and the other polarity are applied to the (chiral smectic) liquid crystal 85, a tilting angle based on the monostabilized position of the average molecular axis of liquid crystal molecules varies continuously depending on the magnitude of the voltage applied to the liquid crystal 85. As a result a light quantity emitted from the liquid crystal device 80 also changes its value depending on the magnitude of the applied voltage, thus allowing a gradational display in combination with a drive circuit (means) for supplying gradation signals to the liquid crystal device 80 connected thereto.

In this instance, a maximum value of the tilting angle (maximum tilting angle) in the case of one polarity-voltage application may preferably be different from that in the case of the other polarity-voltage application. As a result, a corresponding maximum emitting light quantity (first light quantity) in the case of polarity-voltage application is also different from that (second light-quantity) in the case of the other polarity-voltage application.

The maximum tilting angle under one polarity-voltage application may preferably be larger than, more preferably at least five times as large as, that under the other polarity-voltage application. As a result, a corresponding first light quantity is larger than, preferably at least five times as large as, a corresponding second light quantity.

Further, it is also preferred to provide a tilting angle of substantially zero in the case of the other polarity-voltage application.

It is also possible to provide an emitting light quantity (third light quantity) in the absence of voltage application by appropriately arranging a pair of polarizers.

The chiral smectic liquid crystal 85 exhibiting the above-mentioned characteristics may be prepared by using a liquid crystal material which assumes a phase transition series of Iso.-Ch-SmC* or Iso.-SmC* on temperature decrease and has a smectic layer normal direction substantially aligned with one direction and loses its memory characteristic in SmC*.

In order to realize a non-memory state of the liquid crystal 85, it is possible to adopt the following methods (i) to (iv):

(i) a method wherein the liquid crystal 85 disposed between a pair of substrates is supplied with a DC voltage of a positive polarity or negative polarity, (ii) a method wherein oppositely disposed two alignment control films contacting the liquid crystal 85 are formed of different materials, (iii) a method wherein oppositely disposed two alignment control films contacting the liquid crystal 85 are subjected to different treatments in terms of film-forming conditions, rubbing conditions (e.g., rubbing strength), curing conditions (e.g., UV irradiation strength and time), etc., and (iv) a method wherein the undercoating layers different in material and/or thickness are formed under oppositely disposed two alignment control films contacting the liquid crystal 85, respectively.

Specific examples of the (chiral smectic) liquid crystal 85 used in this example may include those used in First Embodiment described above.

Further, also in this embodiment, it is possible to used the liquid crystal device 80 in combination with polarizer(s) similarly as in the above-mentioned First Embodiment.

Next, a driving method for the display apparatus 100 according to this embodiment will be described with reference to FIGS. 16 and 17.

Figure 16:
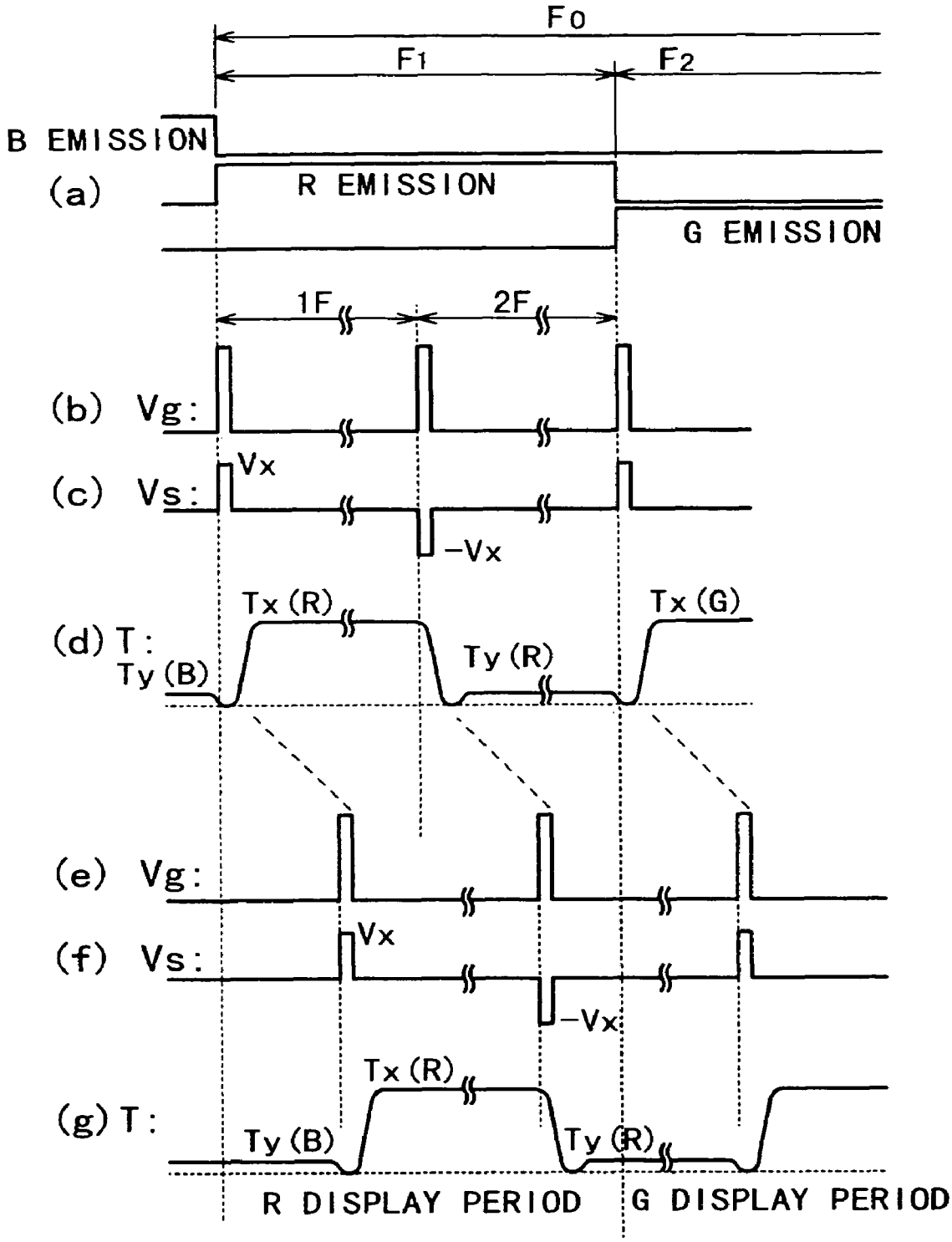
FIGS. 16, 17 and 21 are time charts for illustrating embodiments of the driving method for a liquid crystal display apparatus according to the present invention, respectively.

Referring to FIG. 16, according to the driving method in this embodiment, one frame period F0 is divided into three field periods F1, F2 and F3 and each of the field periods F1, F2 and F3 is further divided into two sub-field periods 1F and 2F (as shown at (a)).

The (liquid crystal) display device 80 is illuminated with a plurality of light source colors issued from the color light source 101 while changing its color for F1, F2 and F3, respectively. In this embodiment, the field periods corresponding to a red (R) display period, a green (G) display period and a blue (B) display period, respectively (as shown at (a) and (g)).

In synchronism with the respective color light emissions, switching of the color light concerned is performed. In this instance, in one (each) field period (e.g., F1), a higher luminance (red) image is displayed in the first sub-field period 1F and a lower luminance (red) image is displayed in the second sub-field period 2F by applying voltages Vg and Vs (as shown at (b), (c) and (d)).

The thus-displayed three color images (R, G and B images) in the three field periods F1, F2 and F3, respectively, are visually color-mixed in one frame period F0 to be recognized as a full-color image.

Figure 17:
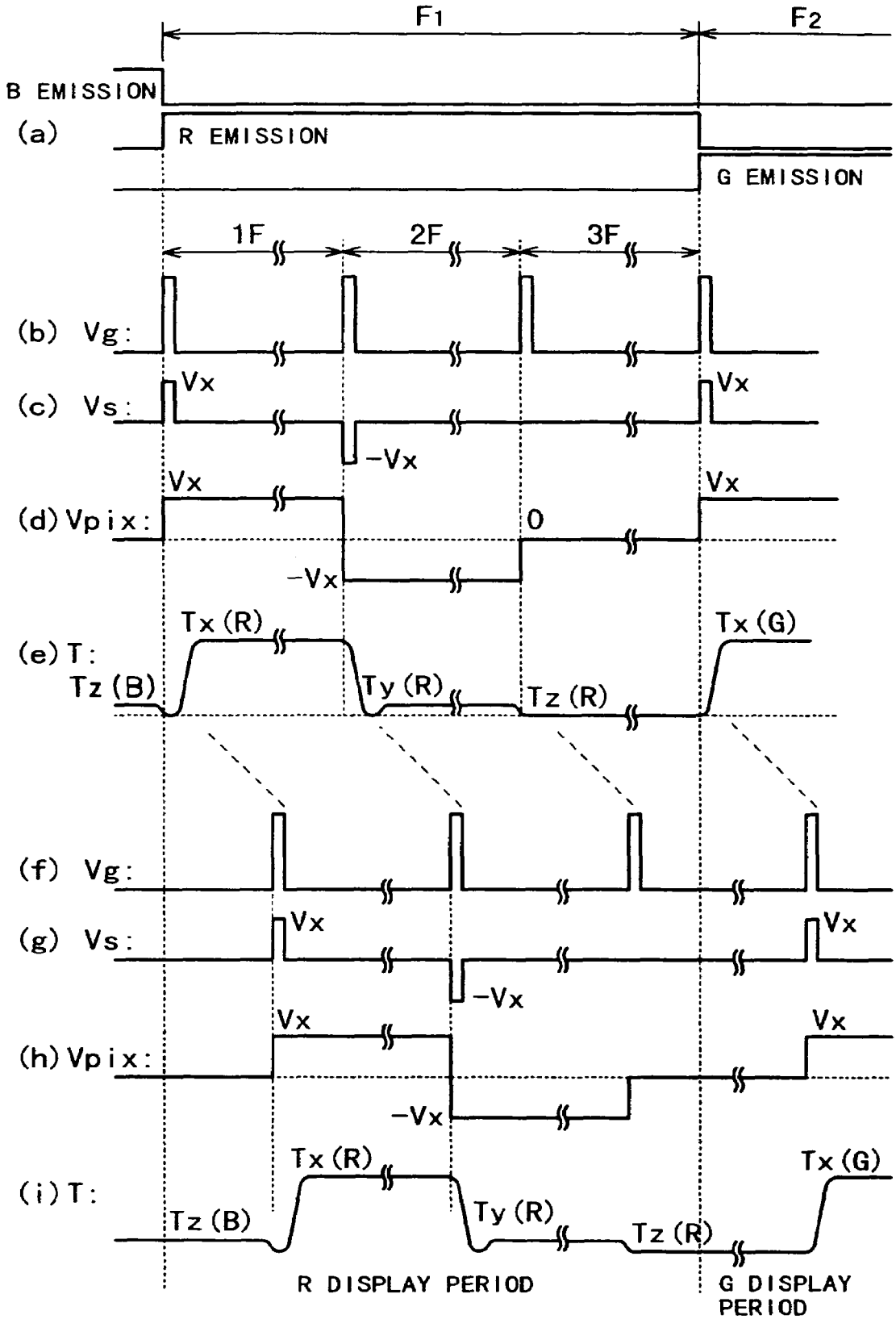

Each of the field periods F1, F2 and F2 may be divided into three sub-field periods 1F, 2F and 3F as shown in FIG. 17.

Referring to FIG. 17, in each field period (e.g., F1 corr. to red (R) image display period), image display for one color (e.g., red image) is performed in such a manner that a higher luminance (red) image is displayed at a transmitted light quantity Tx (R) in the first sub-field period 1F, a lower luminance (red) image is displayed at a transmitted light quantity Ty (R) in the second sub-field period 2F and a substantially no luminance (red) image is displayed at a transmitted light quantity Tz (R) in the third sub-field period 3F (as shown at (a)-(d) in FIG. 17).

The number of the field periods constituting one frame period F0 may be determined, e.g., depending on that of light source colors. In the case of the driving method shown in FIG. 17, one frame period F0 is constituted by three field periods F1, F2 and F3 corresponding to R display period, G display period and B display period, respectively. If four light source colors of R, G, B and W (white) are employed, one frame period F0 may be divided into four field periods F1 for R, F2 for G, F3 for B and F4 for W, respectively.

In this embodiment, in each field period (F1, F2 or F3 (or F4)), the higher and lower luminance (color) images displayed in the first and second sub-field periods 1F and 2F, respectively. These images may be identical to each other except for their luminance levels. Further, the order of display of these images may appropriately be changed, as desired, within each field period so long as each of these images are displayed in one sub-field period (1F, 2F or 3F).

One color image displayed in each field period (F1, F2 or F3) may appropriately be controlled depending on the corresponding light source color, thus improving a color reproducibility of a resultant full-color image displayed in one frame period.

With respect to the luminance of the higher and lower luminance images, the lower luminance image may preferably be controlled to provide a luminance which is non-zero and at most ⅕ of a luminance given by the higher luminance image. Such a luminance control may, e.g., be performed by adjusting a light transmittance of the liquid crystal (display) device 80 through voltage application to the liquid crystal 85 disposed between the pair of electrodes 82*a* and 82*b*. More specifically, when the liquid crystal 85 provides a V-T characteristic as shown in FIG. 7, a positive-polarity voltage (+V1) is applied for displaying the higher luminance image and a negative-polarity voltage (−V1) is applied for displaying the lower luminance image.

The image display operation in the display device 80 may be performed, e.g., in a line-sequential manner.

In this embodiment, in the case where the display device 80 is an active matrix-type liquid crystal device as shown in FIGS. 11 and 12, the liquid crystal apparatus 100 may be driven according to the above-mentioned driving method shown in FIG. 14.

Referring to FIG. 14, at (a) is shown a waveform of gate voltage Vg applied to one gate line Gi; at (b) is shown a waveform of source voltage Vs applied to one source line Sj; at (c) is shown a waveform of voltage Vpix applied to the liquid crystal 49 at a pixel formed at an intersection of these gate and source line Gi an Sj; and at (d) is shown a change in transmitted light quantity T at the pixel.

According to this driving method (FIG. 14), one frame period F0 is divided into three field periods F1, F2 and F2 each of which is further divided into two sub-field periods 1F and 2F.

In this instance, when a frame frequency is 60 Hz, one frame period is ca. 16.7 msec. Each of the field periods F1, F2 and F2 is ca 5.6 msec (≒16.7 msec/3) and each of the sub-field periods 1F and 2F is ca. 2.8 msec (≒ 5.6 msec/2).

The liquid crystal 49 used in this case exhibits a V-T characteristic shown i FIG. 7.

Referring again to FIG. 14, in one sub-field period (e.g., 1F of F1), one gate line Gi is supplied with a gate voltage Vg in a prescribed (selection) period Ton (as shown at (a)) and in synchronism with the gate voltage application, one source line Sj is supplied in the selection period Ton with a source voltage Vs (=V=Vx) based on a potential Vc (reference potential) of a common electrode 12 (FIG. 12) (as shown at (b)) At this time, a TFT 94 at the pixel concerned is turned on by the application of gate voltage g and the source voltage Vx is applied to the liquid crystal 49 via the TFT 94 and a pixel electrode 95, thus charging a liquid crystal capacitor C1*c* and a holding capacitor Cs.

In a non-selection period Toff other than the selection period Ton in the sub-field period 1F, the gate voltage Vg is applied to gate lines G1, G2, . . . , other than the gate line Gi. As a result, the gate line Gi is not supplied with the gate voltage V in the non-selection period Toff, whereby the TFT 94 is turned off. Accordingly, the liquid crystal capacitor C1*c* and holding capacitor Cs hold the electric charges charged therein, respectively, to provide the voltage Vx (=Vpix) through the sub-field period 1F 8 as shown at (c)). The liquid crystal 49 supplied with the voltage Vx through the sub-field period 1F provides a transmitted light quantity Tx substantially constant in the sub-field period 1F (as shown at (d)).

In the subsequent sub-field period 2F (of F1), the above-described gate line Gi is again supplied with the gate voltage Vg (in Ton) (as shown at (a)) and in synchronism therewith, the source line Sj is supplied with a source voltage −Vs (=−V=−Vx) (of a polarity opposite to that of the source voltage Vs in 1F) (as shown at (b)), whereby the source voltage −Vx is charged in the liquid crystal capacitor C1*c* and holding capacitor Cs in Ton and kept in Toff (as shown at (c)).

As described above, the liquid crystal 49 shows the V-T characteristic shown in FIG. 7, so that the resultant transmitted light quantity T1 in the sub-field period 1F under application of the positive-polarity source voltage Vx becomes large and the transmitted light quantity T2 in the sub-field period 2F under application of the negative-polarity source voltage −Vx becomes lower and close to zero. As a result, in the entire field period F1, the resultant transmitted light quantity becomes an average of Tx (=T1) and Ty (=T2). However, bright (Tx) and dark (Ty) display operation can be alternately performed for each sub-field period, thus improving resultant image qualities in the case of effecting motion picture display. Further, the liquid crystal 49 is supplied with the positive-polarity voltage Vx and the negative-polarity voltage −Vx sub-field period by sub-field period in an alternating manner, whereby a deterioration of the liquid crystal 49 in continuous display is prevented.

In this case, the value (magnitude) of the positive-polarity source voltage may be determined based on the V-T characteristic (FIG. 7) of the liquid crystal 49 used and writing information for the pixel concerned (i.e., an optical state or display information at the pixel). In this regard, the transmitted light quantity obtained through the entire field period F1 becomes an average of Tx and Ty as described above, so that when the liquid crystal 49 provides a remarkably low T2, the corresponding T1 (or V1 (=Vx) defining the T1 value) may be set to be a larger value in order to obtain a desired transmitted light quantity (average of Tx and Ty) in the entire field period F1.

The above-mentioned driving method for the display apparatus 100 using the active matrix-type liquid crystal device 80 shown in FIG. 14 may be applicable to a full-color image display in combination with the color light source 101 as shown in FIG. 16.

Referring to FIG. 16, in the (first) field period F1, the liquid crystal device 80 is illuminated with red (R) light emitted from the color light source 101, whereby a black-and-white (monochrome) image on the liquid crystal device 80 is recognized as a red image. Similarly, a monochrome image in the (second) field period F2 is recognized as a green image by green (G) light emission from the color light source 101 and in the (third) field period F3, a monochrome image is recognized as a blue image on the liquid crystal device 80 by blue (B) light emission.

These (three) color images in the field periods F1, F2 and F3 are visually color-mixed in one frame period F0 to be recognized as a full-color image.

Such a full-color image display may also be performed by using the driving method shown in FIG. 17. As described above, in the driving method of FIG. 17, each of the field periods F1, F2 and F3 is divided into three sub-field periods 1F, 2F and 3F.

Referring to FIG. 17, at (a) is shown a timing of emission of respective color lights from the color light source 101; at (b) is shown a waveform of gate voltage Vg applied to one gate line (e.g., first gate line) G1; at (c) is shown a waveform of source voltage Vs applied to one source line Si; at (d) is shown a waveform of voltage Vpix applied to the liquid crystal 49 at a pixel formed at an intersection of these gate and source line G1 an Si; at (e) is shown a change in transmitted light quantity T at the pixel; at (f) is shown a waveform of gate voltage Vg applied to another gate line Gn; at (g) is shown a waveform of source voltage Vs applied to another source line Sj; at (h) is shown a waveform of voltage Vpix applied to the liquid crystal 49 at a pixel formed at an intersection of these gate and source line Gn an Sj; and at (i) is shown a change in transmitted light quantity T at the pixel.

According to this driving method (FIG. 17), the liquid crystal device 80 is driven in the same manner as in the driving method shown in FIG. 14 except that a voltage application operation in the third sub-field period 3F is performed in the following manner.

In the third sub-field period 3F, the gate line G1 is supplied with the gate voltage Vg while keeping a potential on the corresponding source line Si at zero volt (as shown at (b) and (c) of FIG. 17), whereby the charges held in the liquid crystal and holding capacitors C1*c* and Cs are removed to place the liquid crystal 49 in a non-voltage application state, thus resulting in a transmitted light quantity Tz (R) of zero (as shown at (d) and (e)).

In this case, if the gate line Gn is the last gate line and scanned in the above-mentioned manner as in the gate line G1 (as shown at (f), (g), (h) and (i)), a resultant transmitted light quantity through the entire one field period F1 becomes an average of Tx (=T1), Ty (=T2) and Tz (=0).

In the subsequent field period F2, the green (G) light emission may preferably be performed in such a manner that the G emission operation is not effected immediately after the gate voltage Vg application to the last gate line Gn in the third sub-field period 3F of the field period F1 but effected after completely resetting the liquid crystal 49 at the pixel along with the last gate line Gn in a black (dark) state. Consequently, a better color reproducibility can be attained.

According to this embodiment, both of the higher luminance image and the lower luminance image are displayed in each of the field periods F1, F2 and F2, so that the entire one field period (F1 or F2 or F3), a color image having a luminance of an average of those of the higher and lower luminance images is displayed as described above with reference to FIGS. 14 and 16, thus enhancing the resultant luminance for each field period when compared with the conventional driving method as shown in FIG. 20 including non-image display period in each field period. Accordingly, the color light source 101 is not required to provide a higher luminance, thus reducing power consumption.

In the case where the above-described driving method for image display is performed in a line-sequential manner, it is difficult to ensure a scanning timing in synchronism with a light emission timing of the color light source 101 with respect to all the scanning (gate) lines, thus resulting in a deviation between these timings. For this reason, as shown at (g) of FIG. 16 and at (i) of FIG. 17, e.g., when the liquid crystal device 80 is illuminated with a red (R) light emitted from the color light source 101 in the field period F1, with respect to the last gate line, a monochrome image for the preceding blue image is displayed at a transmitted light quantity Ty (B) (as shown at (g) of FIG. 16) or Tz (B) (as shown at (i) of FIG. 17).

In such a case, if the luminance of the monochrome image for the blue image is larger, the resultant color reproducibility is adversely affected by the luminance to be lowered.

In the present invention, however, the luminance of the lower luminance image (i.e., Ty) is set to be non-zero and at most ⅕ of that (Tx) of the higher luminance image (as in the case of the driving method of FIG. 16), thus minimizing the lowering in color reproducibility.

Particularly, in the case of the driving method of FIG. 17, the luminance (Tz (B)) is set to be zero, thus further effectively suppressing the lowering in color reproducibility.

Hereinbelow, the present invention will be described more specifically based on Examples.

EXAMPLE 1

(Blank Cell A)

A blank cell A was prepared in the following manner.

A pair of 1.1 mm-thick glass substrates each provided with a 700 Å-thick transparent electrode of ITO film was provided.

On each of the transparent electrodes (of the pair of glass substrates), a polyimide precursor for forming a polyimide having a recurring unit (PI-a) shown below was applied by spin coating and pre-dried at 80° C. for 5 min., followed by hot-baking at 200° C. for 1 hour to obtain a 200 Å-thick polyimide film.

(PI-a)

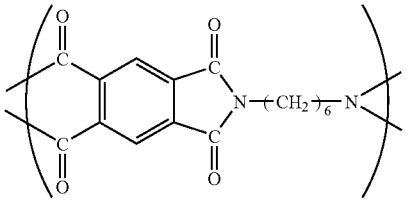

Each of the thus-obtained polyimide film was subjected to rubbing treatment (as a uniaxial aligning treatment) with a nylon cloth under the following conditions to provide an alignment control film.

Rubbing roller: a 10 cm-dia. roller about which a nylon cloth ("NF-77", mfd. by Teijin K. K.) was wound.

Pressing depth: 0.3 mm

Substrate feed rate: 10 cm/sec

Rotation speed: 1000 rpm

Substrate feed: 4 times

Then, on one of the substrates, silica beads (average particle size=2.0 μm) were dispersed and the pair of substrates were applied to each other so that the rubbing treating axes were in parallel with each other but oppositely directed (anti-parallel relationship), thus preparing a blank cell (single-pixel cell) A with a uniform cell gap.

(Black Cell B)

A blank cell B was prepared in the same manner as in the case of the blank cell A except that one of the pair of glass substrate was formed in an active matrix substrate provided with a plurality of a-Si TFTs and a silicone nitride (gate insulating) film and the other glass substrate was provided with a color filter including color filter segments of red (R), green (G) and blue (B).

The thus prepared blank cell (active matrix cell) B having a structure as shown in FIG. 10 had a picture area size of 10.4 inches including a multiplicity of pixels (800×600×RGB).

(Liquid Crystal Devices A and B)

A liquid crystal composition LC-1 was prepared by blending the following mesomorphic (liquid crystal) compounds in the indicated proportions.

| Structural formula | wt. parts |
|---|---|
| 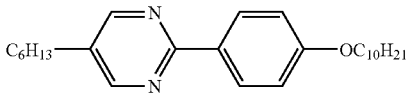 | 17 |
| 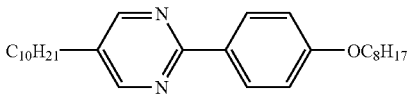 | 17 |
| 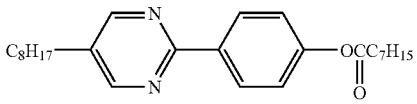 | 11.3 |
| 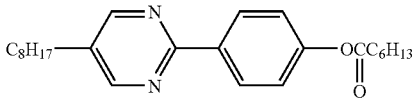 | 11.3 |
| 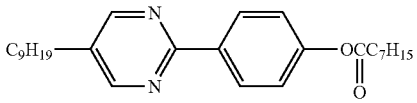 | 11.3 |
| 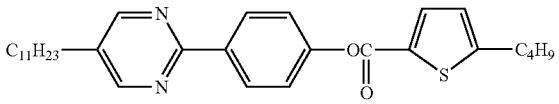 | 30 |
| 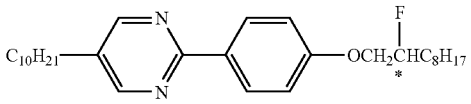 | 2 |

The thus-prepared liquid crystal composition LC-1 showed the following phase transition series and physical properties.

Phase transition temperature (° C.)

$$\text{Iso} \xrightarrow{67.0} \text{Ch} \xrightarrow{50.6} \text{SmC*} \xrightarrow{-9.3} \text{Cry}$$

(Iso: isotropic phase, Ch: cholesteric phase, SmC*: chiral smectic phase)

Spontaneous polarization (Ps): 1.2 nC/cm$^2$ (30° C.)

Cone angle Ⓗ: 23.7 degrees (30° C.)

Helical pitch (SmC*): at least 20 μm (30° C.)

The liquid crystal composition LC-1 was injected into each of the above-prepared blank cells A and B in its isotropic liquid state and gradually cooled to a temperature providing chiral smectic C phase to prepare a (single-pixel) liquid crystal device A and a (active matrix) liquid crystal device B, respectively.

In the above cooling step from Iso to SmC*, each of the cells (devices) A and B was subjected to a voltage application treatment such that a DC (offset) voltage of −5 volts was applied in a temperature range of Tc±2° C. (Tc: Ch-SmC* phase transition temperature) while cooling each device at a rate of 1° C./min.

The thus-prepared liquid crystal devices A and B were evaluated in the following manner in terms of alignment state and optical response characteristics for triangular wave and rectangular wave (for the liquid crystal device A), and motion picture image display characteristic (for the liquid crystal device B), respectively.

<Alignment State>

The alignment state of the liquid crystal composition LC-1 of the liquid crystal device A was observed through a polarizing microscope at 30° C. (room temperature).

As a result, a substantially uniform alignment state such that under no voltage application, the darkest (optical) axis was somewhat deviated from the rubbing direction and only one layer normal direction was present over the entire cell (liquid crystal device A).

<Optical Response to Triangular Wave>

The liquid crystal device A was set in a polarizing microscope equipped with a photomultiplier under cross nicol relationship so that a polarizing axis was disposed to provide the darkest state under no voltage application.

When the liquid crystal device A was supplied with a triangular wave (±5 volts, 0.2 Hz) at 30° C., a resultant transmitted light quantity (transmittance) was gradually increased with the magnitude (absolute value) of the applied voltage under application of the positive-polarity voltage. On the other hand, under application of the negative-polarity voltage, a resultant transmitted light quantity was changed with the applied voltage level but a maximum value of the transmittance was ca. 1/10 of a maximum transmittance in the case of the positive-polarity voltage application.

<Optical Response to Rectangular Wave>

The optical response was evaluated in the same manner as in the above case of using the triangular wave except for using a rectangular wave (±5 volts, 60 Hz) in place of the triangular wave.

As a result, under application of the positive-polarity voltage, the liquid crystal composition LC-1 was found to exhibit a sufficient optical response thereto and provide a stable halftone state independent of a previous state. Further, also under application of the negative-polarity voltage, an optical response (in terms of transmittance) was confirmed similarly as in the case of the positive-polarity application but the value thereof was ca. 1/10 of that in the case of the positive-polarity voltage application when compared at an identical absolute value of the voltages. It was also confirmed that an average value of the resultant transmittance did not depend on that in their previous states, thus attaining a good halftone image display.

Further, under application of the positive-polarity (rectangular wave) voltage application, when a brightening response time (RTb) (a time required to cause a transmittance change from the darkest state to a prescribed transmittance (under application of a prescribed voltage) or a transmittance of 90% based on the maximum transmittance) and a darkening response time (RTd) (a time required to cause a transmittance change from a saturated transmittance state providing a prescribed halftone image to a transmittance of 10% based on the maximum transmittance) was measured.

The results are shown below.

| | (Applied voltage) | |
|---|---|---|
| | ca. 5 V | ca. 1 V |
| RTb (msec) | 0.7 | 2.0 |
| RTd (msec) | 0.3 | 0.2 |

As apparent from the above results, the liquid crystal composition LC-1 shown a good high-speed responsiveness when compared with an ordinary nematic liquid crystal.

<Motion Picture Image Display>

The liquid crystal device B was driven according to the above-mentioned driving method shown in FIG. 14 to evaluate a motion picture quality in the following manner.

Three images (flesh-colored chart, sightseeing information (guide) board, and yacht basin) were selected from Hi-vision standard images (still images) of BTA (Broadcasting Technology Association) and respective central portions (each corr. to 432×168 pixels) of these images were used as three sample images.

These sample images were moved at a speed of 6.8 (deg/sec) corresponding to that of an ordinary TV program to form motion picture images, which were outputted from a computer (as an image source) at a picture rate of 60 frames per 1 sec. in a progressive (sequential scanning) mode, thus evaluating a degree of image blur particularly at a peripheral portion of the outputted images.

Specifically, evaluation of the images was performed by 10 amateur viewers in accordance with the following evaluation standard.

5: Clear and good motion picture image with no peripheral image blur was observed.

4: Slight peripheral image blur was observed but was practically of no problem.

3: Peripheral image blue was observed and it was difficult to recognize fine or small characters.

2: Remarkable peripheral image blur was observed and it was difficult to recognize large characters.

1: Remarkable image blue was observed over the entire picture area and the original sample images were little recognized.

The drive of the liquid crystal device B was first performed at a display rate of 60 frames per 1 sec. in a frame-inversion drive scheme without dividing one frame period into a plurality of field periods.

As a result, a slight peripheral image blur of the motion picture images was observed but was at a practically fully acceptable level between "3" or "4".

Then, the liquid crystal device B was driven according to the driving method shown in FIG. 14 wherein one frame period ca. 16.7 msec) was divided into two field periods (each ca. 8.3 msec) and a positive-polarity voltage was applied in the first field period (Ton=ca. 13.8 μsec) and a negative-polarity voltage (having a voltage level (absolute value) identical to that of the positive-polarity voltage) was applied in the second field period (Ton=ca. 13.8 μsec) to substantially provide a (field) frequency of 120 Hz (=60 Hz×2).

As a result, excellent motion picture images providing a practically sufficient luminance and free from flickering and image blur were observed at a level of "5".

In this regard, when the evaluation was performed with respect to a commercially available CRT monitor, all the viewer evaluated the resultant images as a level of "5". Further, in the case of a commercially available (conventional) TFT liquid crystal panel (generally providing a response time of several ten mill-seconds), the evaluation result was a level between "2" and "3".

EXAMPLE 2

A (single-pixel) liquid crystal device C and an (active matrix) liquid crystal device D were prepared in the same manner as in the liquid crystal devices A and B prepared in Example 1, respectively, except that each of the 200 Å-thick polyimide alignment control film (PI-a) was changed to a 50 Å-thick alignment control film of a polyimide having a recurring unit (PI-b) shown below and that the average particle size (2.0 μm) of the silica beads was changed to 1.4 μm.

(PI-b)

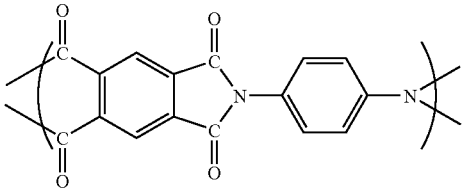

When the thus-prepared liquid crystal devices C and D were evaluated in the same manner as in the liquid crystal devices A and B (used in Example 1), respectively, these liquid crystal devices C and D provided substantially similar characteristics and performances to those of the liquid crystal devices A and B, respectively.

Further, similarly as in Example 1, under application of the positive-polarity (rectangular wave) voltage (to the liquid crystal device C), a brightening response time (RTb) and a darkening response time (RTd) was measured.

The results are shown below.

| | (Applied voltage) | |
|---|---|---|
| | ca. 4 V | ca. 1 V |
| RTb (msec) | 0.6 | 1.7 |
| RTd (msec) | 0.2 | 0.2 |

As apparent from the above results, the liquid crystal composition LC-1 used in the liquid crystal device C shown a good high-speed responsiveness when compared with an ordinary nematic liquid crystal.

EXAMPLE 3

A (single-pixel) liquid crystal device E and an (active matrix) liquid crystal device F were prepared and evaluated in the same manner as in the devices A and B used in Example 1, respectively, except that the anti-parallel rubbing treatment was changed to a parallel rubbing treatment (so that two rubbing treating axes were directed in an identical direction and in parallel with each other), whereby the following results were obtained.

<Alignment State>

When the alignment state of the liquid crystal composition LC-1 of the liquid crystal device E was observed through a polarizing microscope at 30° C., a substantially uniform alignment state such that under no voltage application, the darkest (optical) axis was somewhat deviated from the rubbing direction and only one layer normal direction was present over the entire cell (liquid crystal device E). The alignment state was a co-present state of C1 alignment region and C2 alignment region (1:1).

<Optical Response to Triangular Wave>

When the liquid crystal device E was supplied with a triangular wave (±5 volts, 0.2 Hz) at 30° C., a resultant V-T characteristic over the entire cell was similar to that of the liquid crystal device A used in Example 1. More specifically, in the C1 alignment region, a domain-less switching was observed at a transmittance of at most ca. 50% on voltage increase but an inverted domain was observed when the applied voltage was further increased. In the C2 alignment region, a domain-less switching was observed until the applied voltage reached the saturation voltage. Further, an identical transmittance (transmitted light quantity) was given at a lower applied voltage in the C2 alignment region than that in the C1 alignment region.

<Optical Response to Rectangular Wave>

The optical response characteristic of the liquid crystal device E under the rectangular wave application was similar to that of the liquid crystal device A used in Example 1. Thus, it is possible to effect an analog-like gradational display based on amplitude modulation according to an active matrix driving scheme using TFTs. When the C1 and C2 alignment regions were observed separately, similarly as in the case of the triangular wave application, a prescribed transmittance (transmitted light quantity) in the C2 alignment region was given at an applied voltage lower than that in the case of the C1 alignment region.

Further, when the liquid crystal device E was subjected to measurement of a brightening response time (RTb) and a darkening response time(RTd), the following results were obtained.

| | (Applied voltage) | |
|---|---|---|
| | ca. 5 V | ca. 1 V |
| RTb (msec) | 0.6 | 1.8 |
| RTd (msec) | 0.3 | 0.2 |

As apparent from the above results, the liquid crystal composition LC-1 used in the liquid crystal device E showed a good high-speed responsiveness when compared with an ordinary nematic liquid crystal.

<Motion Picture Image Display>

When the liquid crystal device F was evaluated as to the motion picture image quality (according to the active matrix driving at 60 Hz and 120 Hz similarly as in Example 1), the resultant motion picture images were displayed at a practically sufficient luminance with a peripheral image blur similarly as in Example 1 and the degree of the motion picture image quality was at a level of "5".

EXAMPLE 4

(Blank Cell G)

A blank cell G was prepared in the following manner.

A pair of 1.1 mm-thick glass substrates each provided with a 700 Å-thick transparent electrode of ITO film was provided.

On each of the transparent electrodes (of the pair of glass substrates), a commercially available polyimide alignment film-forming solution for a TFT liquid crystal device ("SE-7992", mfd. by Nissan Kagaku K. K.) was applied by spin coating and pre-dried at 80° C. for 5 min., followed by hot-baking at 200° C. for 1 hour to obtain a 50 Å-thick polyimide film.

Each of the thus-obtained polyimide film was subjected to rubbing treatment (as a uniaxial aligning treatment) with a nylon cloth under the following conditions to provide an alignment control film.

Rubbing roller: a 10 cm-dia. roller about which a nylon cloth ("NF-77", mfd. by Teijin K. K.) was wound.

Pressing depth: 0.3 mm

Substrate feed rate: 10 cm/sec

Rotation speed: 1000 rpm

Substrate feed: 4 times

Then, on one of the substrates, silica beads (average particle size=1.4 μm) were dispersed and the pair of substrates were applied to each other so that the rubbing treating axes were in parallel with each other and directed in an identical direction (parallel relationship), thus preparing a blank cell (single-pixel cell) G with a uniform cell gap.

(Black Cell H)

A blank cell H was prepared in the same manner as in the case of the blank cell A except that one of the pair of glass substrate was formed in an active matrix substrate provided with a plurality of a-Si TFTs and a silicone nitride (gate insulating) film and the other glass substrate was provided with a color filter including color filter segments of red (R), green (G) and blue (B).

The thus prepared blank cell (active matrix cell) H having a structure as shown in FIG. 10 had a picture area size of 10.4 inches including a multiplicity of pixels (800×600×RGB).

(Liquid Crystal Devices G and H)

The liquid crystal composition LC-1 prepared in Example 1 was injected into each of the above-prepared blank cells G and H in its isotropic liquid state and gradually cooled to a temperature providing chiral smectic C phase to prepare a (single-pixel) liquid crystal device G and a (active matrix) liquid crystal device H, respectively.

In the above cooling step from Iso to SmC*, each of the cells (devices) G and H was subjected to a voltage application treatment such that a DC (offset) voltage of −5 volts was applied in a temperature range of Tc±2° C. (Tc: Ch-SmC* phase transition temperature) while cooling each device at a rate of 1° C./min.

The thus-prepared liquid crystal devices G and H were evaluated in the same manner as in Example 1 in terms of alignment state and optical response characteristics for triangular wave and rectangular wave (for the liquid crystal device G), and motion picture image display characteristic (for the liquid crystal device G), respectively.

<Alignment State>

When the alignment state of the liquid crystal composition LC-1 of the liquid crystal device G was observed, a substantially uniform C2 alignment state such that under no voltage application, the darkest (optical) axis was somewhat deviated from the rubbing direction and only one layer normal direction was present over the entire cell (liquid crystal device G).

<Optical Response to Triangular Wave>

When the liquid crystal device G was supplied with a triangular wave (±5 volts, 0.2 Hz) at 30° C., a resultant V-T characteristic was similar to that of the device A used in Example 1. Further, a domain-less switching was observed until the applied voltage reached a saturation voltage.

<Optical Response to Rectangular Wave>

The optical response characteristic of the liquid crystal device G under the rectangular wave application was similar to that of the liquid crystal device A used in Example 1. Thus, it is possible to effect an analog-like gradational display based on amplitude modulation according to an active matrix driving scheme using TFTs.

Further, when the liquid crystal device G was subjected to measurement of a brightening response time (RTb) and a darkening response time(RTd), the following results were obtained.

| | (Applied voltage) | |
|---|---|---|
| | ca. 3 V | ca. 0.6 V |
| RTb (msec) | 0.5 | 1.6 |
| RTd (msec) | 0.2 | 0.2 |

As apparent from the above results, the liquid crystal composition LC-1 used in the liquid crystal device G showed a good high-speed responsiveness when compared with an ordinary nematic liquid crystal.

<Motion Picture Image Display>

When the liquid crystal device H was evaluated as to the motion picture image quality (according to the active matrix driving at 60 Hz and 120 Hz similarly as in Example 1), the resultant motion picture images were displayed at a practically sufficient luminance with a peripheral image blur similarly as in Example 1 and the degree of the motion picture image quality was at a level of "5".

EXAMPLE 5

Figure 18:
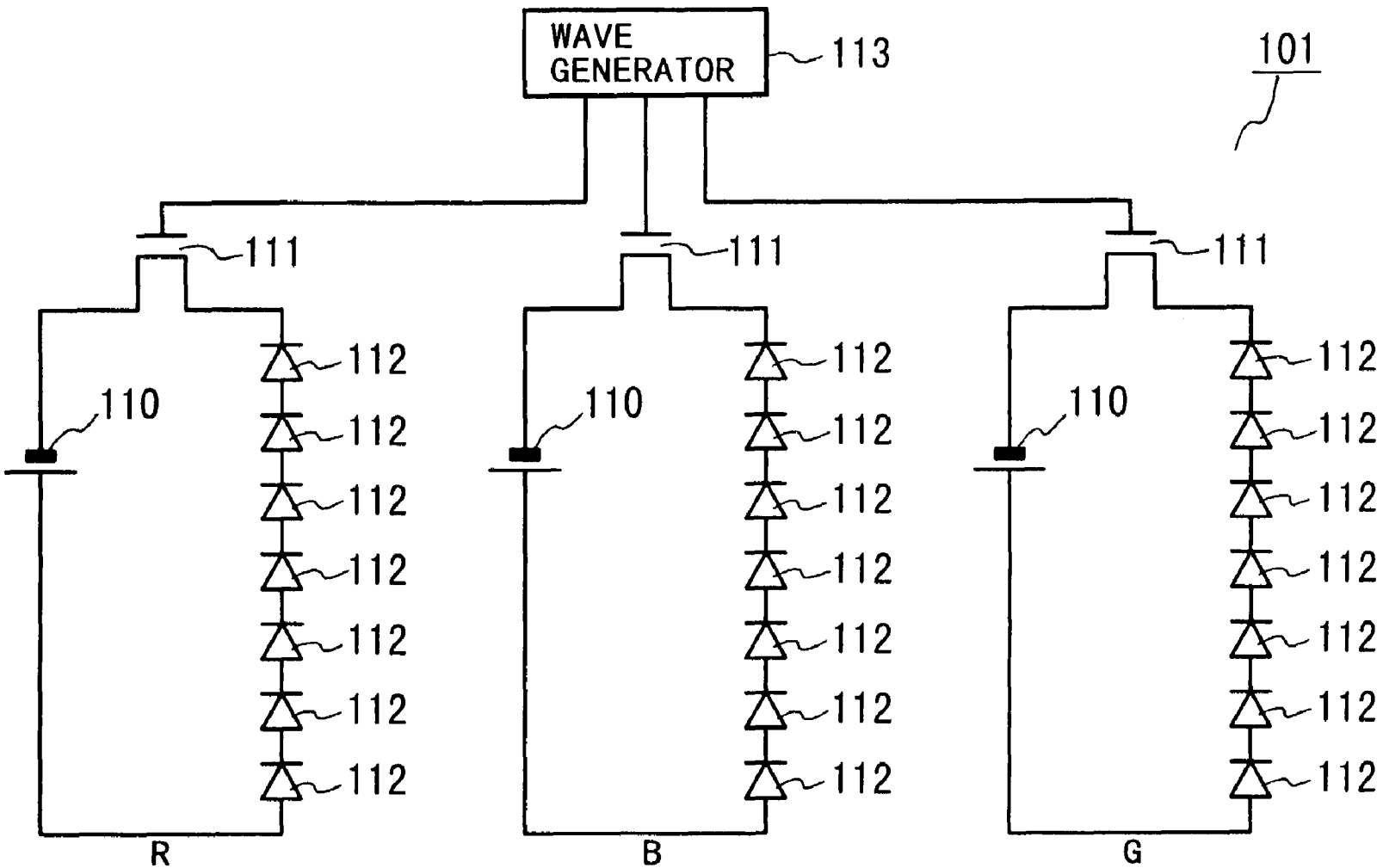
FIG. 18 shows a circuit diagram of an embodiment of a backlight (color light source) used in the present invention.

A color liquid crystal display apparatus was prepared by using a (active matrix) liquid crystal device prepared in the same manner as in the device B used in Example 1 except for omitting the color filter and also using a backlight device 101 (as a color light source) as shown in FIG. 18 in combination.

The backlight device 101, as shown in FIG. 18, included three sets of closed circuits for emitting three colors of red (R), green (G) and blue (B). Each of the closed circuits was comprised of a power source 110, a transistor 111 and seven LEDs (light-emitting diodes) 112 and was electrically connected with a wave generator 113 so as to be appropriately turned on or off, thus allowing a successive emission of the respective lights (of R, G and B).

As materials for the respective light-source lights, CaAlAs was used for R and GaN was used for G and B.

For emission of the respective color lights, a voltage was set to ca. 14 volts for R and ca. 25 volts for G and B and a current was set to at most 20 mA.

The above-prepared liquid crystal display apparatus was driven according to a driving method shown in FIG. 16 (driving voltage=±5 volts, frame-frequency=60 Hz, $f_0$=ca. 16.7 msec, f1=ca. 5.6 msec, 1F=ca. 2.8 msec) to evaluate a (maximum) panel luminance in a white image display state and color purities of the respective color lights (R, G, B).

As a result, the resultant panel luminance was 110 cd/m$^2$. Further, with respect to the color purities were gradually somewhat changed in color tint in order of the scanning lines but were at a level being practically of no problem.

Separately, by using the (single-pixel) liquid crystal device A prepared in Example 1, an optical response to a rectangular wave was evaluated in the same manner as in Example 1 except for changing the frequency from 60 Hz to 180 Hz, whereby a resultant optical response characteristic was similar to that obtained in Example 1.

Comparative Example 1

A (single-pixel) liquid crystal device I and an (active matrix) liquid crystal device J were prepared in the same manner as in Example 1 except that the liquid crystal composition LC-1 was changed to a liquid crystal composition LC-2 prepared below and the DC offset voltage (of −5 volts) was changed to a DC offset voltage of +3 volts.

The liquid crystal composition LC-2 was prepared by mixing the following compounds in the indicated proportions.

| Structural formula | wt. parts |
|---|---|
| 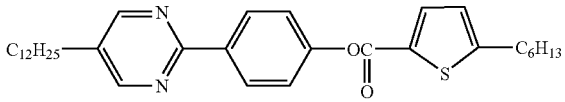 | 10 |
| 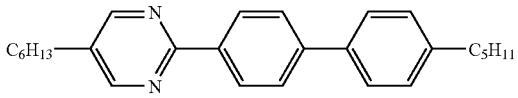 | 80 |
| 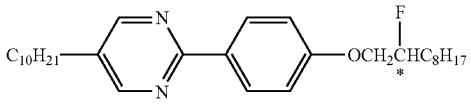 | 5 |

The thus-prepared liquid crystal composition LC-2 showed the following phase transition series and physical properties.

Phase transition temperature (° C.)

Iso. $\xrightarrow{146.6}$ Ch $\xrightarrow{68.8}$ SmC* $\xrightarrow{9.7}$ Cry

Spontaneous polarization (Ps): 1.8 nC/cm$^2$ (30° C.)

Cone angle (Ⓗ): 23.7 degrees (30° C.)

Helical pitch (SmC*): at least 20 μm (30° C.)

The thus-prepared liquid crystal device I was evaluated in the same manner as in Example 1 in terms of alignment state and optical response characteristics for triangular wave and rectangular wave.

<Alignment State>

The alignment state of the liquid crystal composition LC-2 of the liquid crystal device I was observed through a polarizing microscope.

As a result, a substantially uniform alignment state such that under no voltage application, the darkest (optical) axis was substantially aligned with (in parallel with) the rubbing direction and only one layer normal direction was present over the entire cell (liquid crystal device I).

<Optical Response to Triangular Wave>

The liquid crystal device I was set in a polarizing microscope equipped with a photomultiplier under cross nicol relationship so that a polarizing axis was disposed in alignment with the rubbing direction to provide the darkest state under no voltage application.

When the liquid crystal device I was supplied with a triangular wave (±5 volts, 0.2 Hz) at a temperature (T) below the Ch-SmC* phase transition temperature (Tc) by 10° C. (Tc-T=10° C.), a resultant transmitted light quantity (transmittance) was gradually increased with the magnitude (absolute value) of the applied voltage under application of the positive-polarity voltage. On the other hand, under application of the negative-polarity voltage, a resultant transmitted light quantity was substantially not changed from that in a black state (the darkest state) under no voltage application. Further, when the applied voltage was removed in the white (bright) state under the positive-polarity voltage application, switching from the white state to the black state was confirmed.

<Optical Response to Rectangular Wave>

The optical response was evaluated in the same manner as in the above case of using the triangular wave except for using a rectangular wave (±5 volts, 180 Hz) in place of the triangular wave.

As a result, only under application of the positive-polarity voltage, the liquid crystal composition LC-2 was found to exhibit a sufficient optical response thereto, whereby it was possible to change a luminance level depending on a voltage level of the applied (positive-polarity) voltage.

Further, under application of the positive-polarity (rectangular wave) voltage (saturation voltage=ca. 5 volts), a brightening response time (RTb) (a time required to cause a transmittance change from the darkest state to a transmittance of 90% based on a prescribed transmittance (under application of a prescribed voltage) and a darkening response time (RTd) (a time required to cause a transmittance change from a saturated transmittance state (maximum transmittance) to a transmittance of 10% based on the maximum transmittance) was measured.

The results are shown below.

| | (Applied voltage) ca. 5 V |
|---|---|
| RTb (msec) | 0.6-0.9 |
| RTd (msec) | 0.2-0.3 |

As apparent from the above results, the liquid crystal composition LC-2 shown a good high-speed responsiveness and accordingly was confirmed to be applicable to the serial driving scheme using the color light source of R, G and B as in Example 5.

On the other hand, the above-prepared (active matrix) liquid crystal J was used for preparing a color liquid crystal display apparatus in combination with the backlight device 101 (as a color light source) similarly as in Example 5 and was similarly evaluated as in Example 5 according to the serial driving scheme using the color light source of R, G and B while applying a driving voltage of ±5 volts.

As a result, the liquid crystal device J provided a uniform color reproducibility at the entire panel surface but the resultant panel luminance was 100 cd/m$^2$ lower than that (110 cd/m$^2$) of the liquid crystal device B used in Example 5.

EXAMPLE 6

A color liquid crystal display apparatus was prepared and driven in the same manner as in Example 5 except that the driving method (FIG. 16) was changed to that shown in FIG. 17 (driving voltage=±5 volts).

As a result, the color liquid crystal display apparatus showed a good color reproducibility.

When the (single-pixel) liquid crystal device A prepared in Example 1 was evaluated as to an optical response to a rectangular wave (±5 volts, 270 Hz), the resultant optical response characteristic was similar to that obtained in Example 1.

As described hereinabove, according to the present invention, it is possible to provide a liquid crystal device using a chiral smectic liquid crystal capable of allowing a high-speed responsiveness and control of gradation levels while retaining excellent motion picture image qualities and a high luminance.

Further, in the case where in one sub-field, a higher luminance image is displayed in at least one sub-field period and a lower luminance image is displayed in at least one another sub-field period, the resultant image displayed through the entire one sub-field corresponding to an image having a luminance of an average of those of the higher and lower luminance images, thus improving the luminance level compared with the conventional driving scheme including a non-image display period. As a result, it is unnecessary to employ a color light source providing a higher luminance, thus reducing power consumption.

Further, in the case of effecting image display in a line-sequential manner, a lowering in color reproducibility can be effectively suppressed.

What is claimed is:

1. A display apparatus comprising:

a liquid crystal device including a pair of substrates and a liquid crystal disposed between the pair of substrates to form a plurality of pixels; and control means for effecting a plurality of displaying operations at each pixel, each displaying operation including a sequence of a first display operation and a second display operation, wherein the liquid crystal aligns at a mono-stable molecular position of minimum transmittance under no electric field and exhibits a voltage-transmittance characteristic of showing a continuously increased first transmittance in response to an increased magnitude of voltage of a first polarity and a continuously increased second transmittance in response to an increased magnitude of voltage of a second polarity opposite to the first polarity, a saturated maximum of the second transmittance being smaller than a saturated maximum of the first transmittance, and wherein a first drive voltage waveform of the first polarity for providing a desired optical state is applied during the first display operation, and a second drive voltage waveform of the second polarity and of the same amplitude as the first drive voltage waveform is applied during the second display operation, the liquid crystal device thereby displaying an image of a higher luminance in the first display operation and another image of a lower but non-zero luminance in the second display operation.

2. An apparatus according to claim 1, wherein the lower luminance is smaller than ⅕ of the higher luminance.

3. A liquid crystal apparatus comprising:

a liquid crystal device comprising a matrix of pixels; and a drive circuit for driving the liquid crystal device to effect a desired gradation image, wherein a crystal in the liquid crystal device aligns at a mono-stable molecular position of minimum transmittance under no electric field and exhibits a voltage-transmittance characteristic of showing a continuously increased first transmittance in response to an increased magnitude of voltage of a first polarity and a continuously increased second transmittance in response to an increased magnitude of voltage of a second polarity opposite to the first polarity, a saturated maximum of the second transmittance being smaller than a saturated maximum of the first transmittance, and wherein each pixel is supplied with a driving signal from the drive circuit, the driving signal in a first period including a first voltage having the first polarity and an amplitude for providing the desired gradation image and the driving signal in a second period including a second voltage having the second polarity and the same amplitude as the first voltage, the luminance of the pixel in the second period being lower than the luminance of the pixel in the first period but non-zero.

4. An apparatus according to claim 3, wherein the liquid crystal device includes a pair of substrates to sandwich the liquid crystal, and one of the pair of substrates comprises a substrate provided with active devices each electrically connected with an electrode portion defining each of the pixels, and the liquid crystal device is driven by the drive circuit to effect active matrix drive allowing analog-like gradational display.

5. A display apparatus comprising:

a liquid crystal device comprising a plurality of pixels; and control means for effecting a first displaying operation and a second displaying operation within one frame period to the liquid crystal device, wherein a crystal in the liquid crystal device aligns at a mono-stable molecular position of minimum transmittance under no electric field and exhibits a voltage-transmittance characteristic of showing a continuously increased first transmittance in response to an increased magnitude of voltage of a first polarity and a continuously increased second transmittance in response to an increased magnitude of voltage of a second polarity opposite to the first polarity, a saturated maximum of the second transmittance being smaller than a saturated maximum of the first transmittance, and wherein the liquid crystal device displays a desired gradation image in response to a first applied voltage in the first displaying operation, and displays another gradation image in response to a second applied voltage in the second displaying operation, the second applied voltage having the same amplitude and an opposite polarity to the first applied voltage, and a luminance of the gradation image in the second displaying operation being lower than the luminance of the gradation image in the first displaying operation but non-zero.

6. A display apparatus comprising:

a liquid crystal device comprising a plurality of pixels; and control means for effecting a plurality of displaying operations within one frame period to the liquid crystal device, each displaying operation including a sequence of a first operation and a second operation, wherein a crystal in the liquid crystal device aligns at a mono-stable molecular position of minimum transmittance under no electric field and exhibits a voltage-transmittance characteristic of showing a continuously increased first transmittance in response to an increased magnitude of voltage of a first polarity and a continuously increased second transmittance in response to an increased magnitude of voltage of a second polarity opposite to the first polarity, a saturated maximum of the second transmittance being smaller than a saturated maximum of the first transmittance, and wherein the liquid crystal device displays a desired gradation image at a first luminance in the first operation, and displays another gradation image at a second luminance which is non-zero and low than the first luminance in the second operation, by receiving voltages of the same amplitude and opposite polarities in the first and second operations.

* * * * *